US010442653B2

(12) United States Patent
Oiwa et al.

(10) Patent No.: US 10,442,653 B2
(45) Date of Patent: Oct. 15, 2019

(54) SHEET PROCESSING APPARATUS

(71) Applicant: Duplo Seiko Corporation, Kinokawa-shi, Wakayama (JP)

(72) Inventors: Hideki Oiwa, Kinokawa (JP); Tomoyuki Nagayama, Kinokawa (JP); Akane Tokutake, Kinokawa (JP)

(73) Assignee: Duplo Seiko Corporation, Kinokawa-shi, Wakayama (JP)

( * ) Notice: Subject to any disclaimer, the term of this patent is extended or adjusted under 35 U.S.C. 154(b) by 0 days.

(21) Appl. No.: 15/697,761

(22) Filed: Sep. 7, 2017

(65) Prior Publication Data

US 2018/0079617 A1 Mar. 22, 2018

(30) Foreign Application Priority Data

Sep. 21, 2016 (JP) ..... 2016-184610

(51) Int. Cl.
*B65H 37/00* (2006.01)
*B65H 35/02* (2006.01)
(Continued)

(52) U.S. Cl.
CPC ..... *B65H 35/02* (2013.01); *B26D 1/245* (2013.01); *B26D 5/00* (2013.01); *B31F 1/0025* (2013.01);
(Continued)

(58) Field of Classification Search
CPC ..... B26D 1/245; B26D 3/085; B26D 5/00; B26D 9/00; B26F 1/08; B31F 1/0025;
(Continued)

(56) References Cited

U.S. PATENT DOCUMENTS 4,887,502 A * 12/1989 Voges ..... B23D 35/007 83/479
7,134,372 B2 * 11/2006 Flaherty ..... B23D 35/004 83/425.4
2006/0145415 A1 * 7/2006 Oota ..... B23D 35/008 271/264

FOREIGN PATENT DOCUMENTS

EP 2754631 A1 7/2014
JP 2012-91278 A 5/2012
WO 2015093245 A1 6/2015

OTHER PUBLICATIONS

The extended European Search Report dated Mar. 16, 2018, by the European Patent Office in corresponding European Application No. 17189477.7. (7 pages).

* cited by examiner

*Primary Examiner* — Stephen Choi
(74) *Attorney, Agent, or Firm* — Buchanan Ingersoll & Rooney PC

(57) ABSTRACT

The apparatus includes: a conveyance directional processing part for performing processing along the conveyance direction onto the sheet, the conveyance directional processing part being constructed such that at the same position in the conveyance direction, a plurality of processing machines of two or more types are aligned in a width direction perpendicular to the conveyance direction and provided in a freely attachable and detachable manner; a condition input part through which processing conditions in the conveyance directional processing part are inputted; a display part for displaying the processing conditions; and a processing machine selection control part for acquiring types and arrangement of the processing machines to be provided in the conveyance directional processing part such that the
(Continued)

processing conditions may be satisfied and then displaying the acquired types and arrangement on the display part.

16 Claims, 38 Drawing Sheets

(51) Int. Cl.

| | |
|---|---|
| ***B26D 5/02*** | (2006.01) |
| ***B65H 5/06*** | (2006.01) |
| ***B65H 7/20*** | (2006.01) |
| ***B65H 35/00*** | (2006.01) |
| ***B65H 37/06*** | (2006.01) |
| ***B65H 43/02*** | (2006.01) |
| ***B26D 1/24*** | (2006.01) |
| ***B26D 5/00*** | (2006.01) |
| ***B31F 1/00*** | (2006.01) |
| *B26D 3/08* | (2006.01) |
| *B26D 9/00* | (2006.01) |
| *B26F 1/08* | (2006.01) |

(52) U.S. Cl.
CPC ..... *B65H 5/062* (2013.01); *B65H 7/20* (2013.01); *B65H 35/008* (2013.01); *B65H 37/06* (2013.01); *B65H 43/02* (2013.01); *B26D 3/085* (2013.01); *B26D 9/00* (2013.01); *B26F 1/08* (2013.01); *B65H 2301/515323* (2013.01); *B65H 2801/21* (2013.01)

(58) Field of Classification Search
CPC .... B65H 2301/515323; B65H 2801/21; B65H 35/008; B65H 35/02; B65H 37/06; B65H 43/02; B65H 5/062; B65H 7/20
See application file for complete search history.

SHEET PROCESSING APPARATUS

BACKGROUND OF THE INVENTION

Field of the Invention

The present invention relates to a sheet processing apparatus for processing a sheet in the course of conveyance of the sheet.

Background Art

In general, a sheet processing apparatus includes a plurality of processing parts provided along the conveyance direction. Then, as a type of the processing part, a conveyance directional processing part is known that is constructed such that a plurality of processing machines of two or more types are mounted and aligned in the width direction perpendicular to the conveyance direction of the sheet, that is, at the same position in the conveyance direction, so that processing along the conveyance direction is performed.

PRIOR ART REFERENCES

Patent Documents

[Patent Document 1] JP 2012-91278 A

SUMMARY OF THE INVENTION

Problems to be Solved by the Invention

Meanwhile, in the conveyance directional processing part, the types and arrangement of the plurality of processing machines of two or more types need be settled such that the processing conditions may be satisfied. Nevertheless, in some cases, degraded processing machines need be exchanged into new processing machines or, alternatively, in association with a change in the processing conditions, original processing machines need be exchanged into processing machines of different types. In such cases, in the sheet processing apparatus of the conventional art, there has been a possibility that a mistake is made in the types and arrangement of the processing machines.

An object of the present invention is to provide a sheet processing apparatus in which even when processing machines are to be exchanged, processing machines can be mounted without a mistake in the types and arrangement.

Means for Solving the Problem

The present invention is characterized by a sheet processing apparatus for processing a sheet in the course of conveyance of the sheet, comprising:

a conveyance directional processing part for performing processing along the conveyance direction onto the sheet, the conveyance directional processing part being constructed such that at the same position in the conveyance direction, a plurality of processing machines of two or more types are aligned in a width direction perpendicular to the conveyance direction and provided in a freely attachable and detachable manner;

a condition input part through which processing conditions in the conveyance directional processing part are inputted;

a display part for displaying the processing conditions; and a processing machine selection control part for acquiring types and arrangement of the processing machines to be provided in the conveyance directional processing part such that the processing conditions may be satisfied and then displaying the acquired types and arrangement on the display part.

Effect of the Invention

According to the present invention, when the processing conditions in the conveyance directional processing part are inputted, the processing machine selection control part is invoked so that the types and arrangement of the processing machines can automatically be determined. This avoids a situation that at the time of exchange of the processing machines, a mistake is made in the types and arrangement of the processing machines.

DETAILED DESCRIPTION

A sheet processing apparatus of the present invention is described below with reference to embodiments.

First Embodiment (Overall Configuration)

Figure 1:
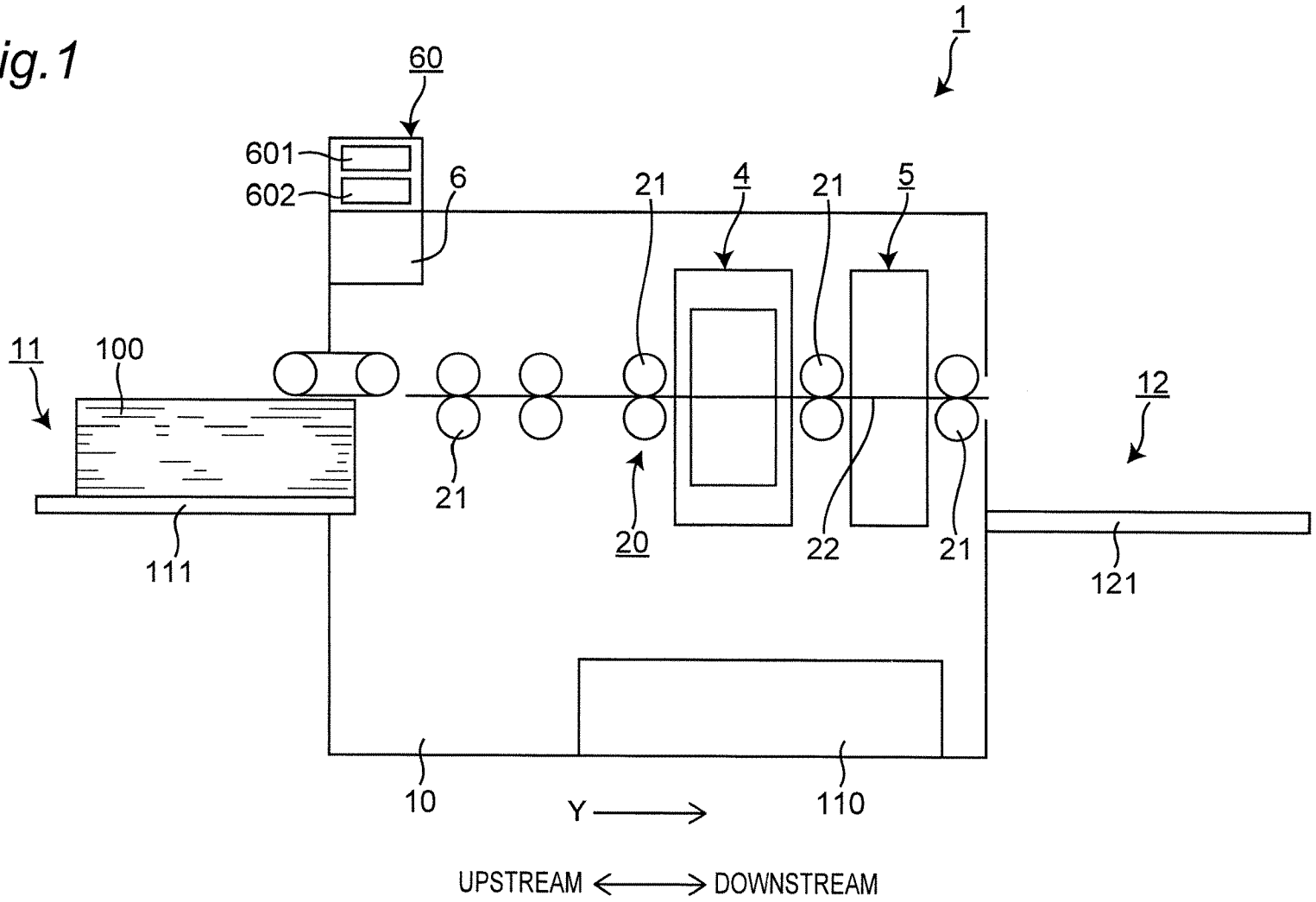
FIG. 1 is a vertical sectional schematic view showing a sheet processing apparatus of a first embodiment of the present invention.

FIG. 1 is a vertical sectional schematic view showing a sheet processing apparatus of a first embodiment of the present invention. The sheet processing apparatus 1 includes a paper feeding part 11 provided with a paper feed tray 111 and a paper ejection part 12 provided with a paper ejection tray 121 each provided at each end of an apparatus body 10. A conveyance path 22 from the paper feeding part 11 to the paper ejection part 12 is constructed by a conveyance part 20 composed of a large number of pairs of rollers 21. The conveyance part 20 conveys a sheet 100 one by one in an arrow Y direction from the paper feeding part 11 toward the paper ejection part 12. In the conveyance direction indicated by the arrow Y, the paper feeding part 11 side is referred to as the "upstream" and the paper ejection part 12 side is referred to as the "downstream". Then, in the conveyance path 22, in the order from the paper feeding part 11 side, a conveyance correction part, an information read part, a rejection part, and the like (not shown) are provided and then processing parts 4 and 5 are provided. Here, the processing part 4 is a conveyance directional processing part for processing the sheet along the conveyance direction Y at arbitrary positions in the width direction. The processing part 5 is a width directional processing part for processing the sheet along the width direction of the sheet. Here, the "width direction" indicates a direction perpendicular to the conveyance direction. Further, when the paper ejection part 12 side is viewed from the paper feeding part 11 side, the rightward in the width direction is referred to as a "right side" (or, simply, the "right") and the leftward in the width direction is referred to as a "left side" (or, simply, the "left").

Further, in the sheet processing apparatus 1, a control part 6 for controlling the operation of the entire apparatus is provided in the inside of the apparatus body 10. The control part 6 is implemented by a CPU, a ROM, a RAM, or the like. An operation panel 60 is connected to the control part 6. Further, in the sheet processing apparatus 1, a trash box 110 for accommodating shreds (also including scraps) generated by the processing on the sheet is provided in the bottom of the apparatus body 10.

(Operation Panel)

Figure 2:
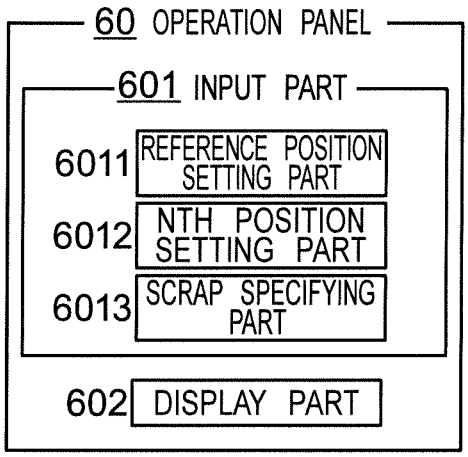
FIG. 2 is a block diagram of an operation panel.

FIG. 2 is a block diagram of the operation panel 60. The operation panel 60 includes an input part 601 and a display part 602. The input part 601 allows the operator to input processing conditions concerning the sheet. That is, the input part 601 serves as a "condition input part". The display part 602 can display the inputted processing conditions.

Further, by virtue of the input part 601, the right end or the left end of the sheet in the width direction can be set as a reference position. Further, an Nth processing position which is an Nth cutting position counted from the reference position can be setup. Furthermore, a sheet piece to be excluded can be specified as a scrap. That is, the input part 601 serves also as a "reference position setting part 6011", an "Nth position setting part 6012", and a "scrap specifying part 6013". Here, N is an integer greater than or equal to 1.

Figure 3:
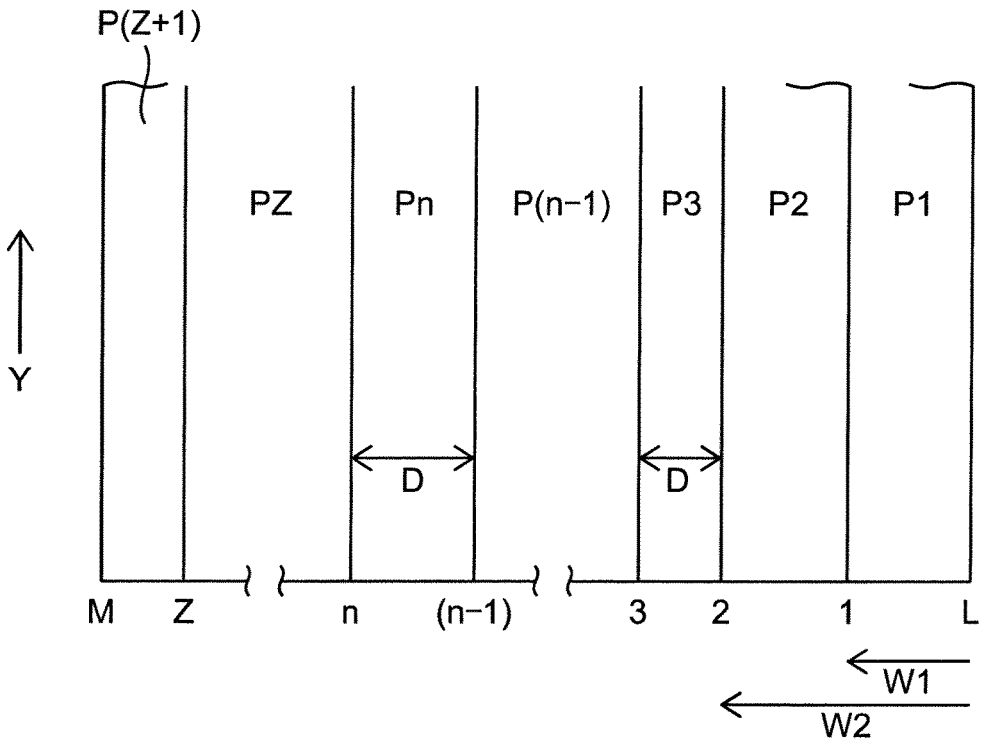
FIG. 3 shows an example of processing contents for a sheet of a first embodiment.

FIG. 3 shows an example of processing contents for the sheet. In these processing contents, the sheet is to be processed at a "first processing position", a "second processing position", a "third processing position", an "(n−1)th processing position", an "nth processing position", and a "Zth processing position" located in this order from the reference position L side. Here, n is an integer greater than or equal to 2 and smaller than or equal to Z. Further, Z indicates the number of a processing position most distant from the reference position L and is "10" in the present embodiment. That is, in the present embodiment, the total number of processing machines that can be mounted on the conveyance directional processing part 4 is "10". Processing conditions of such processing contents are inputted as follows.

By using the reference position setting part 6011, the right end of the sheet in the width direction is set as the reference position L.

By using the Nth position setting part 6012, the Nth processing position is set up as a width WN measured from the reference position L.

By using the scrap specifying part 6013, sheet pieces to be excluded as scraps are specified from among the sheet pieces P1, P2, P3, P(n−1), Pn, PZ, and P(Z+1) having been processed. Employable methods for this specification include: (a) a method that a sheet piece having a width dimension D smaller than a predetermined value is "regarded as a scrap" and (b) a method that whether the sheet piece on the reference position L side of the Nth processing position and the sheet piece of the side distant from the reference position L at the Zth processing position are to be regarded as scraps is "selected by the operator". Here, in the present embodiment, the method (a) and the method (b) may be combined together so that a part of sheet pieces may be specified as sheet pieces to be excluded as scraps by the method (b) and then the remaining sheet pieces may be specified as sheet pieces to be excluded as scraps by the method (a).

(Conveyance Directional Processing Part)

Figure 4:
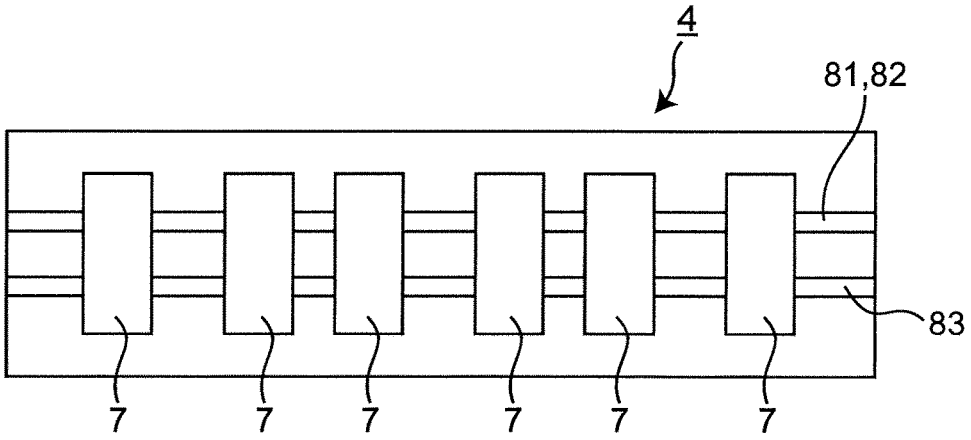
FIG. 4 is a schematic view of a conveyance directional processing part viewed from the downstream in the conveyance direction.

The conveyance directional processing part 4 is constructed such that a plurality of processing machines 7 of two or more types are provided and aligned in the width direction as shown in FIG. 4.

Figure 5:
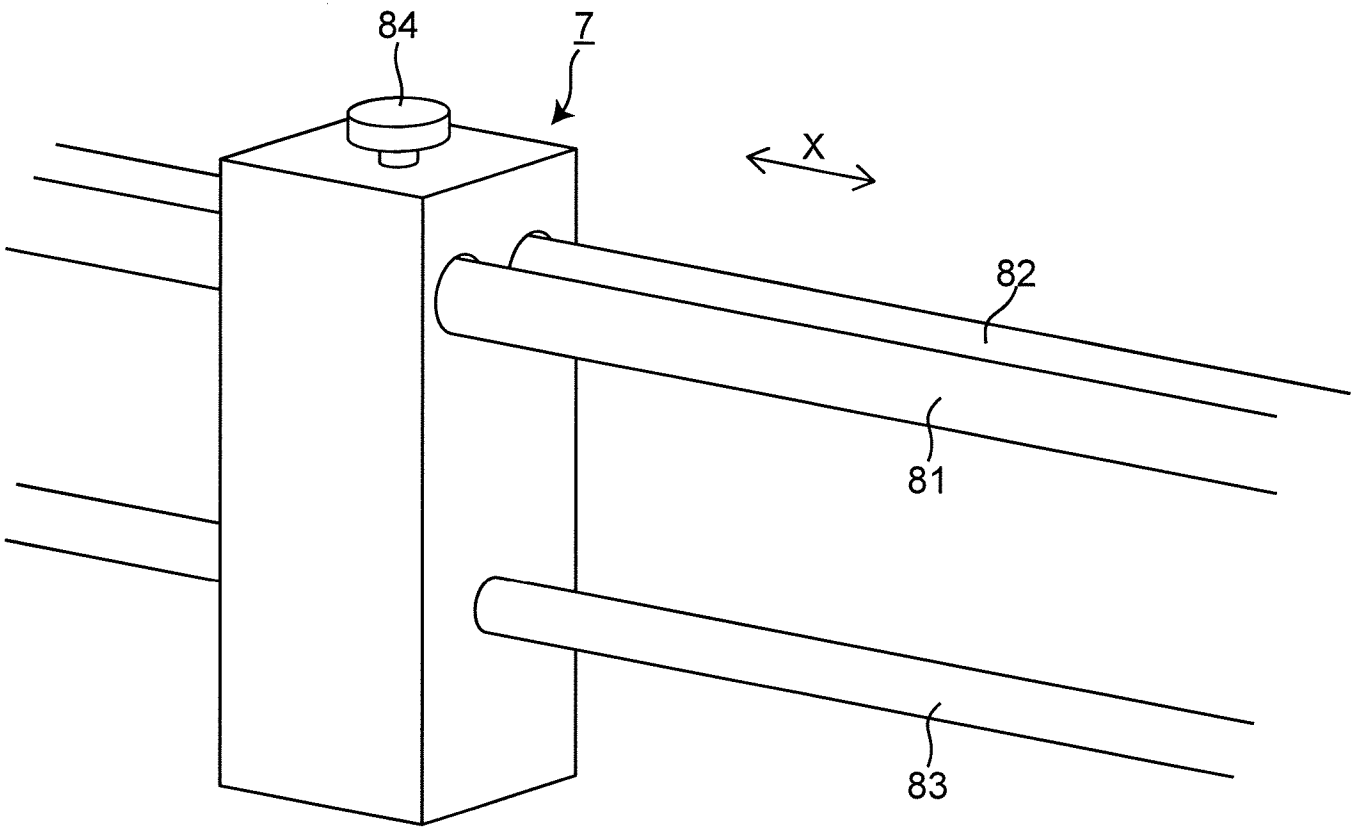
FIG. 5 is a perspective view showing a state that a processing machine is mounted.

As shown in FIG. 5, each processing machine 7 can manually be moved in the width direction X along two slide shafts 81 and 82 and a drive shaft 83 and then can be fixed at an arbitrary position on the slide shafts 81 with a screw 84. That is, the processing machine 7 can be arranged at an arbitrary position in the width direction X. Here, the position of the processing machine 7 can correctly be set up on the basis of a scale provided in parallel to the slide shafts 81 and 82. Further, the movement of the processing machine 7 may be performed by an electric mechanism.

Further, a configuration is employed that one end side of the slide shafts 81 and 82 and the drive shaft 83 can be opened in an integrated manner without the necessity of a special tool and then the processing machine 7 can be put in or out through the one end side so as to be attached or detached. Thus, the processing machine 7 can easily be exchanged.

As the processing machines 7 of two or more types, for example, the following five types of processing machines can be employed.

Figure 6:
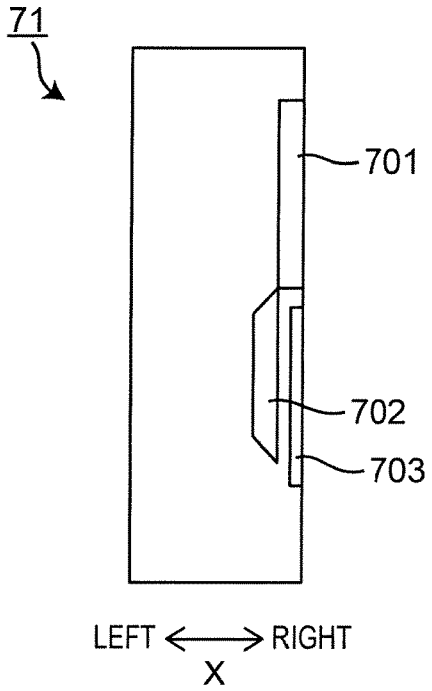
FIG. 6 is a diagram of a right type slitter viewed from the upstream in the conveyance direction.

(a) Right Type Slitter 71 (FIG. 6)

FIG. 6 is a diagram of the right type slitter 71 viewed from the upstream in the conveyance direction. The right type slitter 71 is a slitter constructed such that an upper rotary blade 701 and a lower rotary blade 702 revolve in a manner of being rubbed together so that cutting processing along the conveyance direction is performed on the sheet. In the right type slitter 71, the upper rotary blade 701 is located on the right side of the lower rotary blade 702 in the width direction. Further, the right type slitter 71 includes a scrap exclusion member 703 provided on the right side of the lower rotary blade 702 in the width direction. Here, the scrap exclusion member 703 can be displaced between an exclusion mode in which a scrap is excluded and a retreat mode in which a scrap is not excluded.

Figure 7:
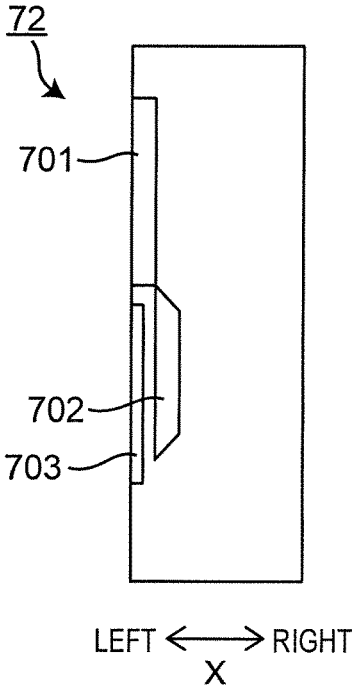
FIG. 7 is a diagram of a left type slitter viewed from the upstream in the conveyance direction.

(b) Left Type Slitter 72 (FIG. 7)

FIG. 7 is a diagram of the left type slitter 72 viewed from the upstream in the conveyance direction. The left type slitter 72 is a slitter constructed such that an upper rotary blade 701 and a lower rotary blade 702 revolve in a manner of being rubbed together so that cutting processing along the conveyance direction is performed on the sheet. In the left type slitter 72, the upper rotary blade 701 is located on the left side of the lower rotary blade 702 in the width direction. Further, the left type slitter 72 includes a scrap exclusion member 703 provided on the left side of the lower rotary blade 702 in the width direction. Here, the scrap exclusion member 703 can be displaced between an exclusion mode in which a scrap is excluded and a retreat mode in which a scrap is not excluded. That is, the right type slitter 71 and the left type slitter 72 have entirely right-left symmetric configurations to each other.

Figure 8:
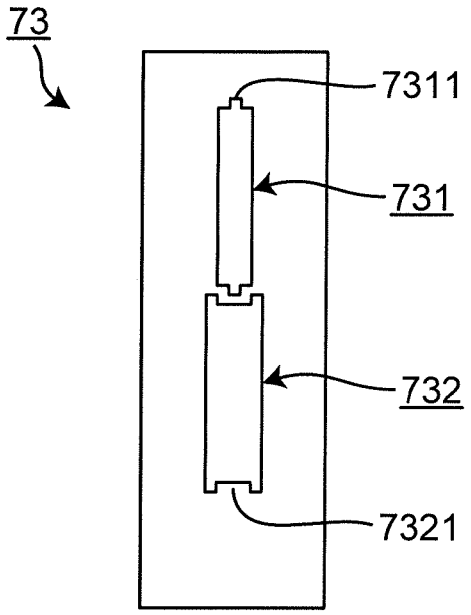
FIG. 8 is a diagram of a longitudinal crease forming machine viewed from the downstream in the conveyance direction.

(c) Longitudinal Crease Forming Machine 73 (FIG. 8)

FIG. 8 is a diagram of a longitudinal crease forming machine 73 viewed from the downstream in the conveyance direction. The longitudinal crease forming machine 73 is constructed such that a protrusion 7311 of an upper rotary blade 731 together with the sheet is fit in a recess 7321 of a lower rotary blade 732 so that the sheet is pressed and thereby a crease (a fold mark) is formed in the sheet.

Figure 9:
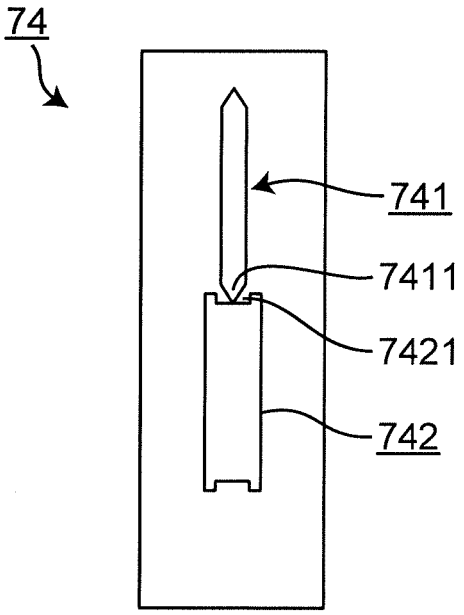
FIG. 9 is a diagram of a longitudinal perforation line forming machine viewed from the downstream in the conveyance direction.

(d) Longitudinal Perforation Line Forming Machine 74 (FIG. 9)

FIG. 9 is a diagram of a longitudinal perforation line forming machine 74 viewed from the downstream in the conveyance direction. The longitudinal perforation line forming machine 74 is constructed such that acute angle tip parts 7411 of an upper rotary blade 741 constructed from a gear-wheel-shaped blade go through the sheet in part and then go into recesses 7421 of a lower rotary blade 742 so that a perforation line is formed in the sheet.

(e) Longitudinal Micro Perforation Line Forming Machine

A longitudinal micro perforation line forming machine has a similar configuration to the longitudinal perforation line forming machine 74. However, in comparison with the longitudinal perforation line forming machine 74, smaller acute angle tip parts 7411 are provided at a smaller pitch in the circumferential direction.

(Control Part)

Figure 10:
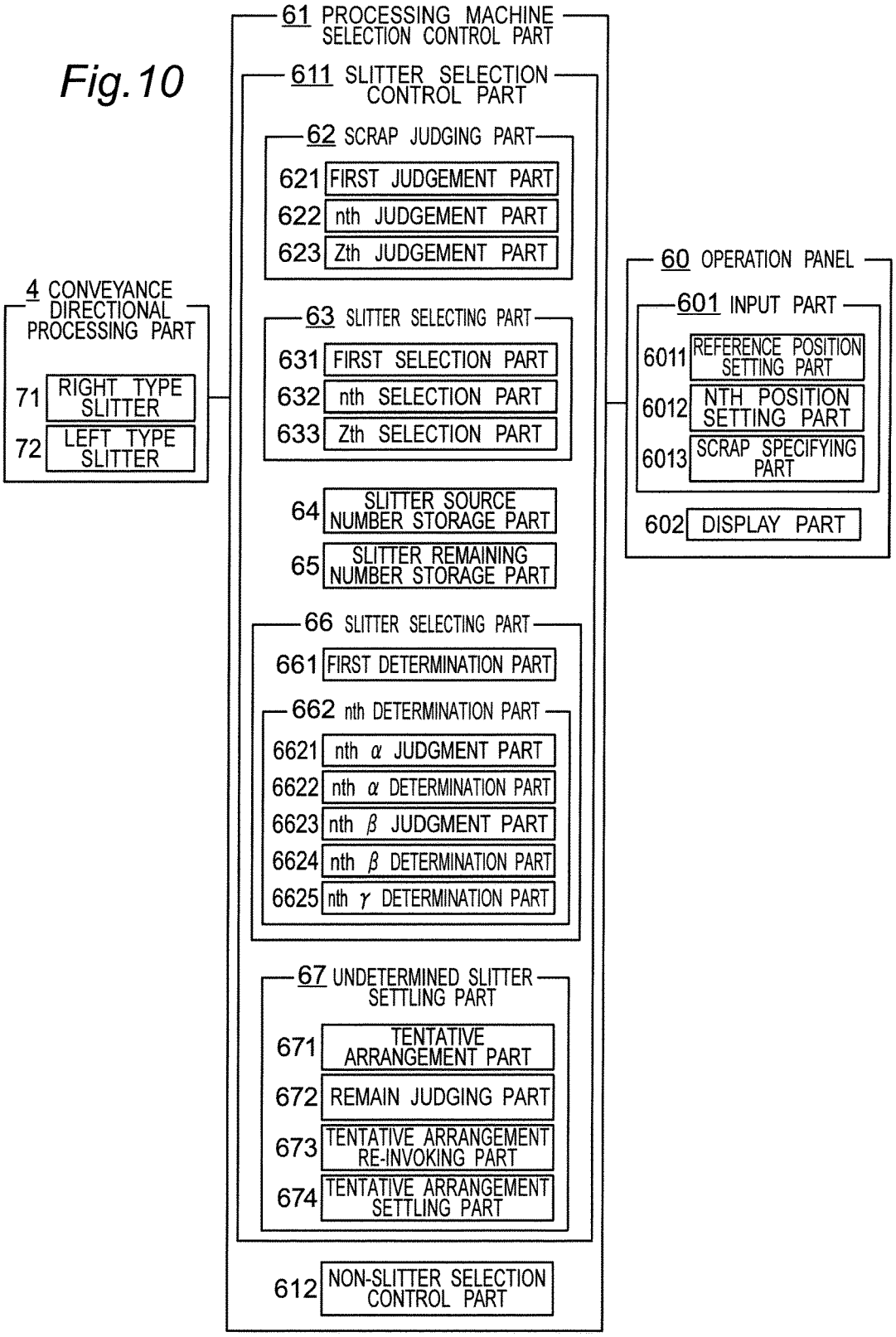
FIG. 10 is a block diagram of a sheet processing apparatus of the present embodiment including a processing machine selection control part.

FIG. 10 is a block diagram of the sheet processing apparatus of the present embodiment including a processing machine selection control part 61. The control part 6 includes the processing machine selection control part 61 for acquiring the types and arrangement of the processing machines 7 to be provided in the conveyance directional processing part 4 such that processing conditions may be satisfied and then displaying the acquired types and arrangement onto the display part 602. That is, the display part 602 can display the types and arrangement of the processing machines 7 that satisfy processing conditions.

The processing machine selection control part 61 includes: a slitter selection control part 611 for selecting a slitter; and a non-slitter selection control part 612 for selecting a processing machine other than a slitter. Then, as shown in FIG. 10, the slitter selection control part 611 includes a "scrap judging part 62", a "slitter selecting part 63", a "slitter source number storage part 64", a "slitter remaining number storage part 65", a "slitter determining part 66", and an "undetermined slitter settling part 67".

(a) Scrap Judging Part 62

The scrap judging part 62 judges whether the sheet piece formed on the reference position side or the counter-reference position side of the Nth processing position is a scrap. More specifically, the scrap judging part 62 includes a "first judgement part 621", an "nth judgement part 622", and a "Zth judgement part 623".

The first judgment part 621, when N=1 is set up by the Nth position setting part, judges whether the sheet piece formed on the reference position side of the first processing position is a scrap.

The nth judgement part 622, when an integer n greater than or equal to 2 and smaller than Z is specified by the Nth position setting part, judges whether the sheet piece formed on the reference position side of the nth processing position is a scrap.

The Zth judgment part 623, when N=Z is set up by the Nth position setting part, judges whether the sheet piece formed on the counter-reference position side of the Zth processing position is a scrap.

(b) Slitter Selecting Part 63

The slitter selecting part 63 operates as described in the following (i) to (iv).

(i) When the judgment result of the scrap judging part 62 is "the sheet piece on the reference position side is a scrap" and the reference position is the right end L, the right type slitter 71 is selected as the slitter to be employed at the Nth processing position.

(ii) When the judgment result of the scrap judging part 62 is "the sheet piece on the reference position side is a scrap" and the reference position is the left end M, the left type slitter 72 is selected as the slitter to be employed at the Nth processing position.

(iii) When the judgment result of the scrap judging part 62 is "the sheet piece on the counter-reference position side is a scrap" and the reference position is the right end L, the left type slitter 72 is selected as the slitter to be employed at the Nth processing position.

(iv) When the judgment result of the scrap judging part 62 is "the sheet piece on the counter-reference position side is a scrap" and the reference position is the left end M, the right type slitter 71 is selected as the slitter to be employed at the Nth processing position.

Specifically, the slitter selecting part 63 includes a "first selection part 631", an "nth selection part 632", and a "Zth selection part 633".

The first selection part 631, when the judgment result of the first judgement part 621 is "a scrap", selects as the slitter to be employed at the first processing position the right type slitter 71 in a case that the reference position is the right end L or selects the left type slitter 72 in a case that the reference position is the left end M.

The nth selection part 632, when the judgment result of the nth judgement part 622 is "a scrap", selects, in a case that the reference position is the right end L, the right type slitter 71 as the slitter to be employed at the nth processing position and the left type slitter 72 as the slitter to be employed at the (n−1)th processing position or selects, in a case that the reference position is the left end M, the left type slitter 72 as the slitter to be employed at the nth processing position and the right type slitter 71 as the slitter to be employed at the (n−1)th processing position.

The Zth selection part 633, when the judgment result of the Zth judgement part 623 is "a scrap", selects as the slitter to be employed at the Zth processing position the left type slitter 72 in a case that the reference position is the right end L or selects the right type slitter 71 in a case that the reference position is the left end M.

Meanwhile, in a case that sheet pieces adjacent to each other in the width direction with the Nth processing position in between are both regarded as scraps, an inconsistency arises when the slitter selecting part 63 selects the slitter to be employed at the Nth processing position. Thus, (i) when processing conditions causing an inconsistency are inputted, an error is informed so that the operator is prompted to input appropriate processing conditions or (ii) restrictions are placed on the processing conditions inputted through the input part 601, so that a situation is avoided that sheet pieces adjacent to each other in the width direction with the Nth processing position in between are both specified as scraps.

(c) Slitter Source Number Storage Part 64

The slitter source number storage part 64 stores a source number T indicating the number of each of the right type slitters 71 and the left type slitters 72 prepared in advance.

(d) Slitter Remaining Number Storage Part 65

The slitter remaining number storage part 65, at each time that the right type slitter 71 or the left type slitter 72 is selected by the slitter selecting part 63, subtracts the selected one from the source number T so as to acquire a remaining number Q of each of the right type slitters 71 and the left type slitters 72 and then stores the acquired value.

(e) Slitter Determining Part 66

The slitter determining part 66, when the judgment result of the scrap judging part 62 is "the sheet piece on the reference position side is not a scrap", determines that the slitter to be employed at the Nth processing position is "undetermined" or of the same type as the slitter to be employed at the (N−1)th processing position.

Specifically, the slitter determining part 66 includes a "first determination part 661" and an "nth determination part 662".

The first determination part 661, when the judgment result of the first judgement part 621 is "not a scrap", determines that the slitter to be employed at the first processing position is "undetermined".

The nth determination part 662 is invoked when the judgment result of the nth judgement part 622 is "not a scrap". Specifically, the nth determination part 662 includes an "nth α judgment part 6621", an "nth α determination part 6622", an "nth β judgment part 6623", an "nth β determination part 6624", and an "nth γ determination part 6625".

The nth α judgment part 6621 judges whether a width dimension D of the sheet piece formed on the reference position side of the nth processing position is greater than a predetermined dimension B.

The nth α determination part 6622, when the judgment result of the nth α judgment part 6621 is "D>B", determines that the slitter to be employed at the nth processing position is "undetermined".

The nth β judgment part 6623, when the judgment result of the nth α judgment part 6621 is "D≤B", judging whether the slitter to be employed at the (n−1)th processing position is "undetermined" and whether the remaining numbers of the right type slitters 71 and the left type slitters 72 are both one or greater.

The nth β determination part 6624, when the judgment result of the nth β judgment part 6623 is "yes", determines that the slitter to be employed at the nth processing position is "undetermined".

The nth γ determination part 6625, when the judgment result of the nth β judgment part 6623 is "no", determines that the slitter to be employed at the nth processing position is of the same type as the slitter to be employed at the (n−1)th processing position.

Figure 11:
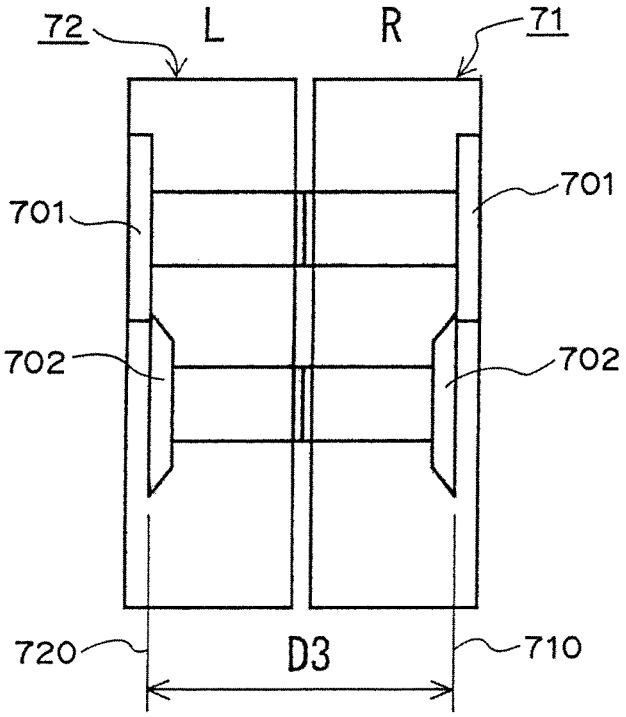
FIG. 11 is a diagram showing an example of a width dimension of a sheet piece cut out in a case that a right type slitter and a left type slitter are in close contact with each other.
Figure 12:
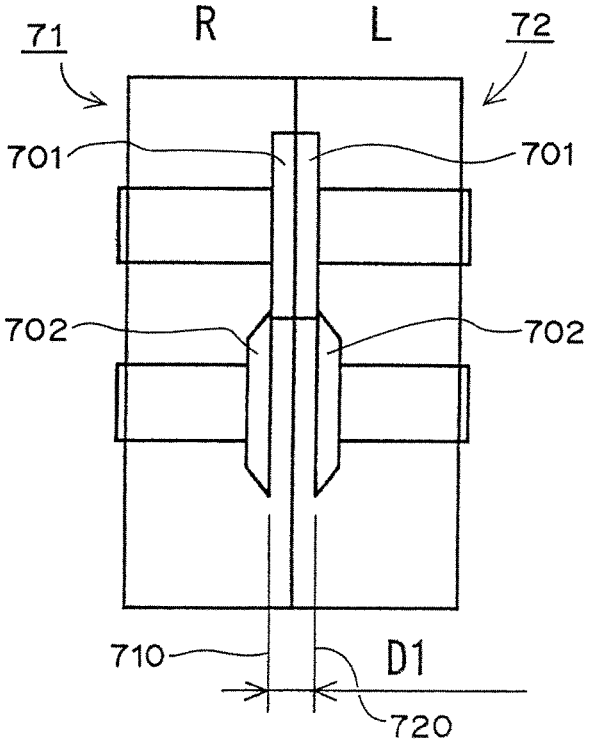
FIG. 12 is a diagram showing another example of a width dimension of a sheet piece cut out in a case that a right type slitter and a left type slitter are in close contact with each other.

Here, as shown in FIG. 11, "B" indicates a width dimension D3 between a cutting processing position 710 of the right type slitter 71 and a cutting processing position 720 of the left type slitter 72 in a state that the right type slitter 71 (abbreviated to "R") arranged on the right side in the width direction and the left type slitter 72 (abbreviated to "L") arranged on the left side in the width direction are in close contact with each other. Meanwhile, as shown in FIG. 12, the width dimension between the cutting processing position 710 of the right type slitter 71 and the cutting processing position 720 of the left type slitter 72 in a state that the right type slitter 71 arranged on the left side in the width direction and the left type slitter 72 arranged on the right side in the width direction are in close contact with each other is D1 which is a value smaller than or equal to a width dimension A in which the sheet piece is regarded as a scrap on the basis of the dimension. In the present embodiment, "A" is 25 mm.

(f) Undetermined Slitter Settling Part 67

The undetermined slitter settling part 67 settles the slitter to be employed at the Nth processing position and having been concluded as "undetermined" by the slitter determining part 66. Specifically, the undetermined slitter settling part 67 includes a "tentative arrangement part 671", a "remain judging part 672", a "tentative arrangement re-invoking part 673", and a "tentative arrangement settling part 674".

The tentative arrangement part 671 selects one from three patterns consisting of (i) the right type slitter 71 is adoptable, (ii) the left type slitter 72 is adoptable, and (iii) both the right type slitter 71 and the left type slitter 72 are adoptable as the slitter to be employed at the Nth processing position and having been concluded as "undetermined", and then successively performs tentative arrangement.

The remain judging part 672 judges whether the number of each of the right type slitters 71 and the left type slitters 72 tentatively arranged falls within the range of the remaining number Q.

The tentative arrangement re-invoking part 673, when the judgment result of the remain judging part 672 is "not within the range of the remaining number Q", re-invokes the tentative arrangement part 671 to newly perform tentative arrangement.

When the judgment result of the remain judging part 672 is "within the range of the remaining number Q", the tentative arrangement is settled.

(Operation)

Figure 13:
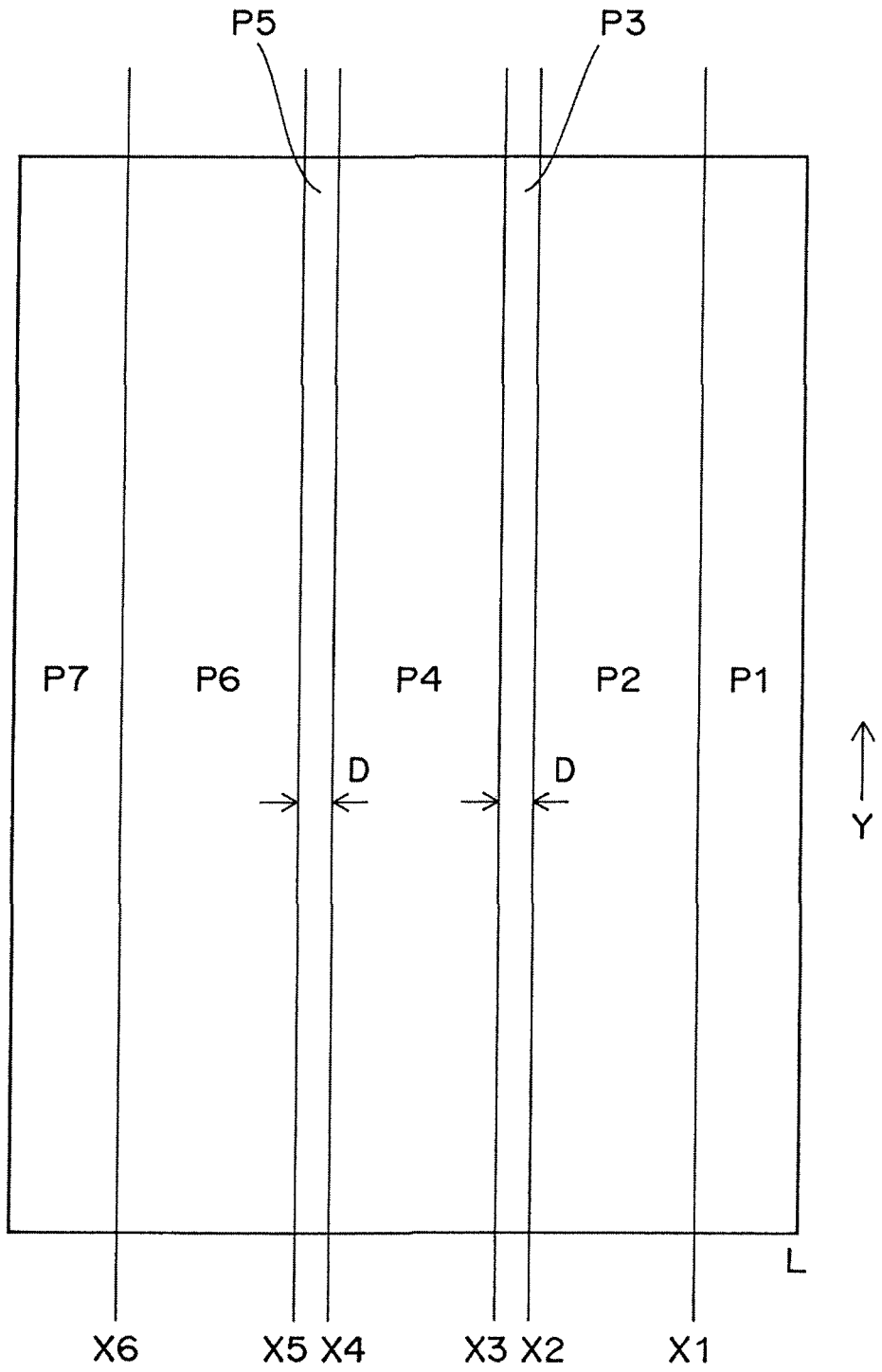
FIG. 13 is a diagram showing an example in which all processing contents are cutting processing.

As an example, the following description is given for a case that the processing contents to be performed on the sheet are entirely cutting processing as shown in FIG. 13. Here, the source number T of each of the right type slitters 71 and the left type slitters 72 is premised to be 4.

Figure 15:
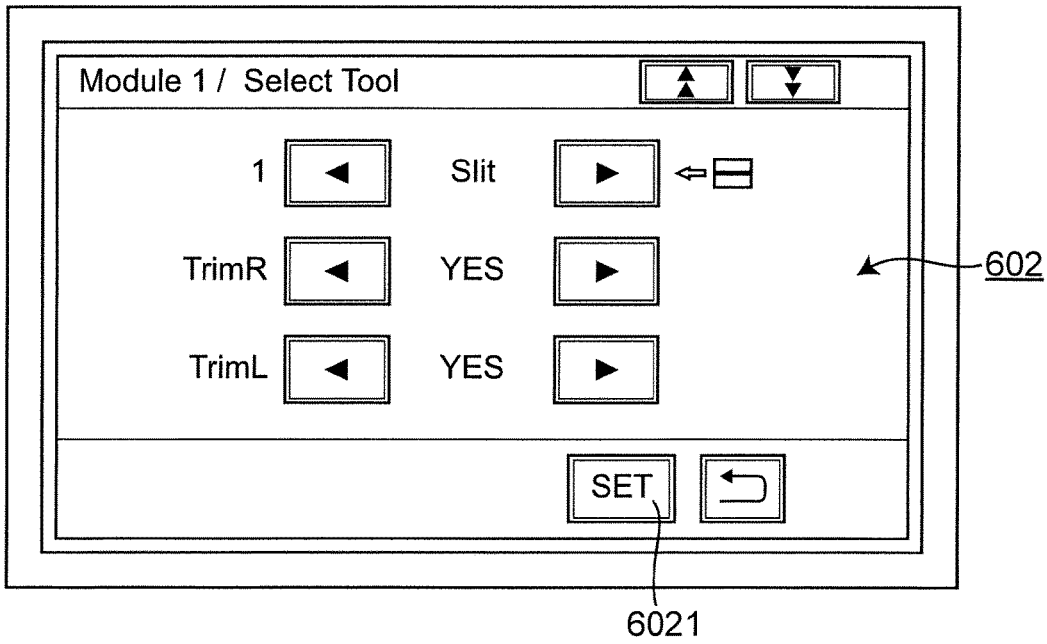
FIG. 15 is a diagram showing a situation of input of a margin specification in a display part.

(1) First, processing conditions are inputted through the input part 601. That is, first, the right end of the sheet in the width direction is set as the reference position L by using the reference position setting part 6011. Then, as shown in the display part 602 of FIG. 15, a situation that the sheet piece P1 at the right end (TrimR) is a scrap and a situation that the sheet piece P7 at the left end (TrimL) is a scrap (YES) are inputted through the scrap specifying part 6013. Then, the first to the sixth processing position X1 to X6 are set up as width directional distances WN from the reference position L by using the Nth position setting part 6012.

Figure 14:
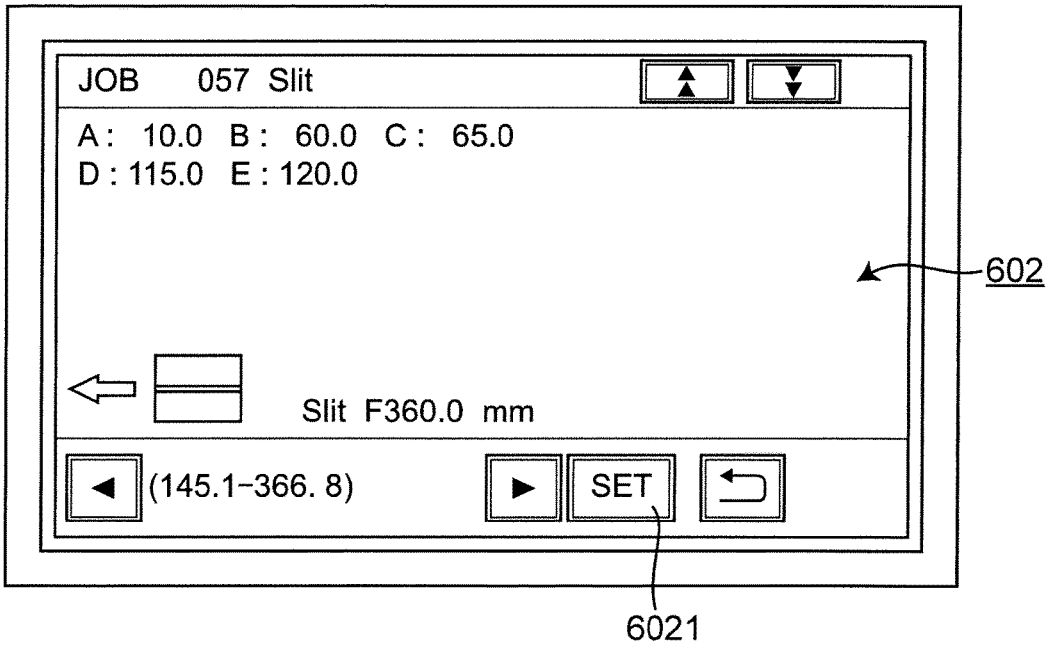
FIG. 14 is a diagram showing a situation of input of processing conditions in a display part.

Specifically, as shown in the display part 602 of FIG. 14, a first processing position X1 of "10.0" mm, a second processing position X2 of "60.0" mm, a third processing position X3 of "65.0" mm, a fourth processing position X4 of "115.0" mm, a fifth processing position X5 of "120.0" mm, and a sixth processing position X6 of "360.0" mm are successively inputted. Here, a specification that a sheet piece having a width dimension smaller than a predetermined width dimension A is to be regarded as a scrap is successively inputted through the scrap specifying part 6013. In the processing contents in FIG. 13, the width dimensions D of the sheet pieces P3 and P5 are 5.0 mm and hence smaller than the width dimension A. That is, in the processing contents in FIG. 13, Z is 6 and cutting processing is to be performed at the first to the sixth processing position X1 to X6 and then the sheet pieces P1, P3, P5, and P7 among the sheet pieces P1 to P7 are excluded as scraps.

(2) Further, at each time that the width directional distance WN of each of the processing positions X1 to X6 is inputted, when a SET 6021 in the display part 602 is pressed by using the input part 601, the processing machine selection control part 61 is invoked. This operation is described below with reference to the flow charts shown in FIGS. 16 to 19.

Here, in the flow charts, "Slit" indicates a slitter, "Slit 1" indicates the slitter at the first processing position X1, "Slit N" indicates the slitter at the Nth processing position, "R-blade" indicates the right type slitter 71, "L-blade" indicates the left type slitter 72, "N" is an integer greater than or equal to 1, "D" indicates a width dimension between adjacent processing positions, "A" indicates a maximum width dimension of a sheet piece regarded as a scrap and is 25 mm as described above, and "B" is a width dimension greater than "A" and is D3 mentioned above which is 48 mm in the present embodiment. Symbol "S" is an abbreviation to "step". However, in the flow charts, the "N" in the steps concerning the operation at and after the second processing position is obviously an integer greater than or equal to 2.

Figure 16:
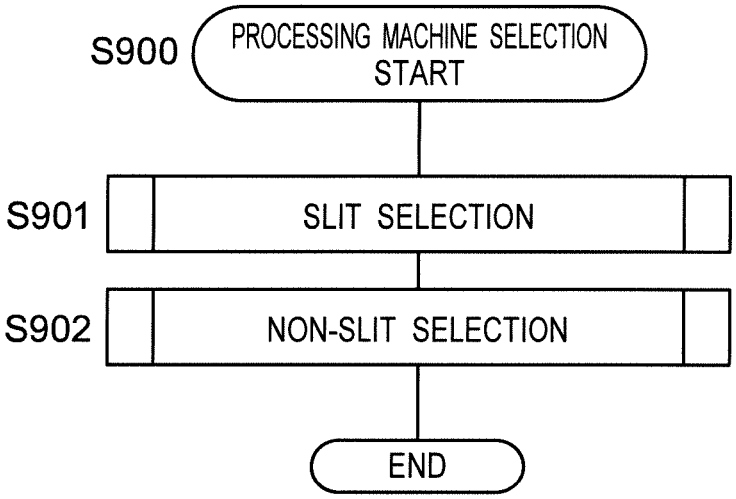
FIG. 16 is a flow chart of operation of a processing machine selection control part.
Figure 17:
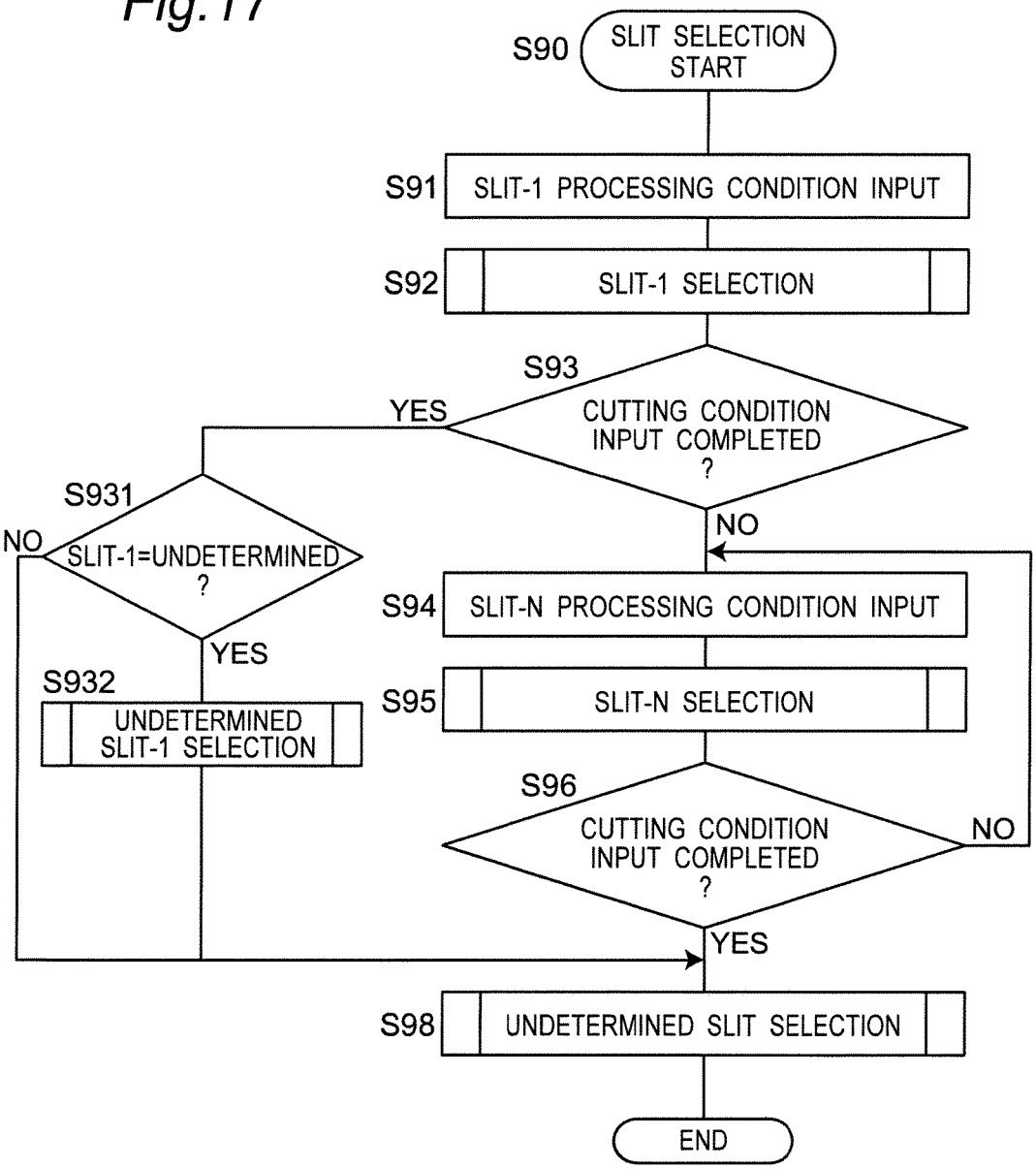
FIG. 17 is a flowchart of operation of a slitter selection control part.

First, as shown in FIG. 16, when the operation of the processing machine selection control part 61 is started (S900), the slitter selection control part 611 is invoked (S901) so that slitter selection operation shown in FIG. 17 is executed.

(2-1) First Processing Position X1

Figure 18:
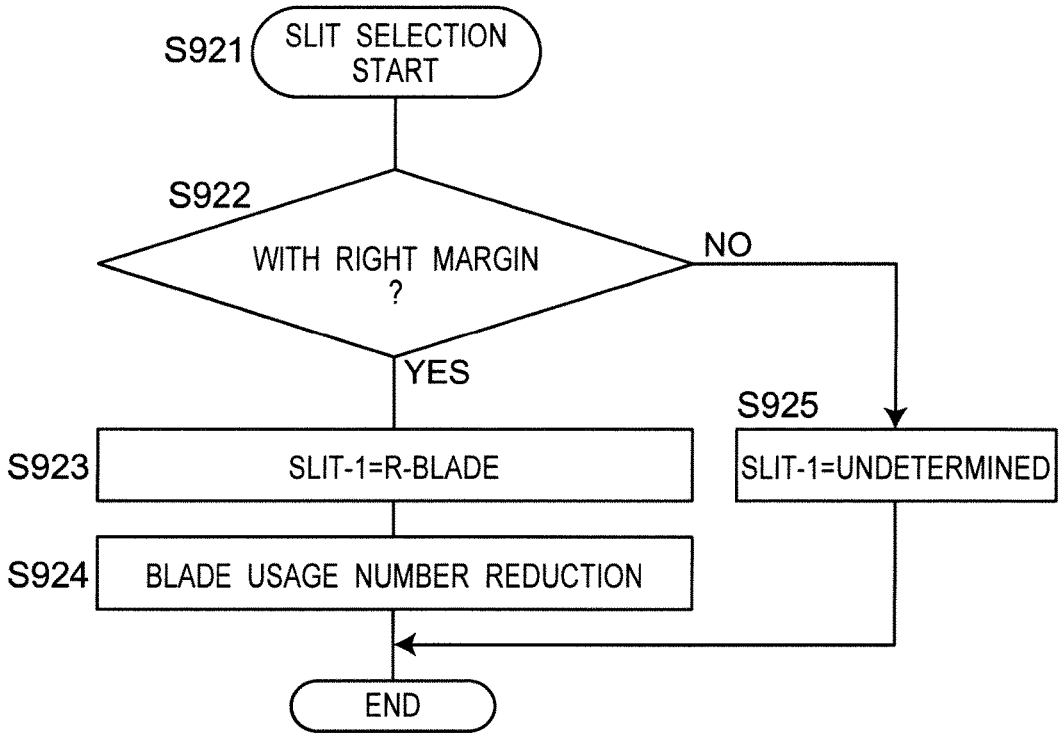
FIG. 18 is a flow chart of selection operation for a slitter at a first processing position.

First, as shown in FIG. 17, the operation of the slitter selection control part 611 is started (S90) and then when an input of the first processing position X1 is received (S91), selection of the slitter at the first processing position X1 (S92) is performed so that the operation shown in FIG. 18 is executed. In FIG. 18, when selection of the slitter at the first processing position X1 is started (S921), the first judgement part 621 is invoked and judges whether the sheet piece P1 is a scrap (S922). Here, "with a right margin" indicates that the sheet piece at the rightmost end is to be excluded as a scrap.

In the present example, the sheet piece P1 is "a scrap". Thus, the first selection part 631 selects the right type slitter 71 (S923) and then the slitter remaining number storage part 65 is invoked and subtracts one from the remaining number of the right type slitters 71 (S924).

Meanwhile, when the sheet piece P1 is "not a scrap", the first determination part 661 is invoked and determines that the slitter to be employed at the first processing position X1 is "undetermined" (S925).

Then, it is judged whether input of processing conditions has been completed (S93). When the input is not completed, the procedure goes to input of a processing condition concerning the next processing position (S94). On the other hand, for example, in a case that cutting processing is to be performed at one position alone, the input is already completed. When the input has been completed, it is judged whether the slitter at the first processing position is "undetermined" (S931). In the case of "undetermined", selection of the undetermined slitter at the first processing position (an additional operation 1 described later) is performed (S932). In the case of not being "undetermined", the procedure is terminated.

(2-2) Second Processing Position X2

Figure 19:
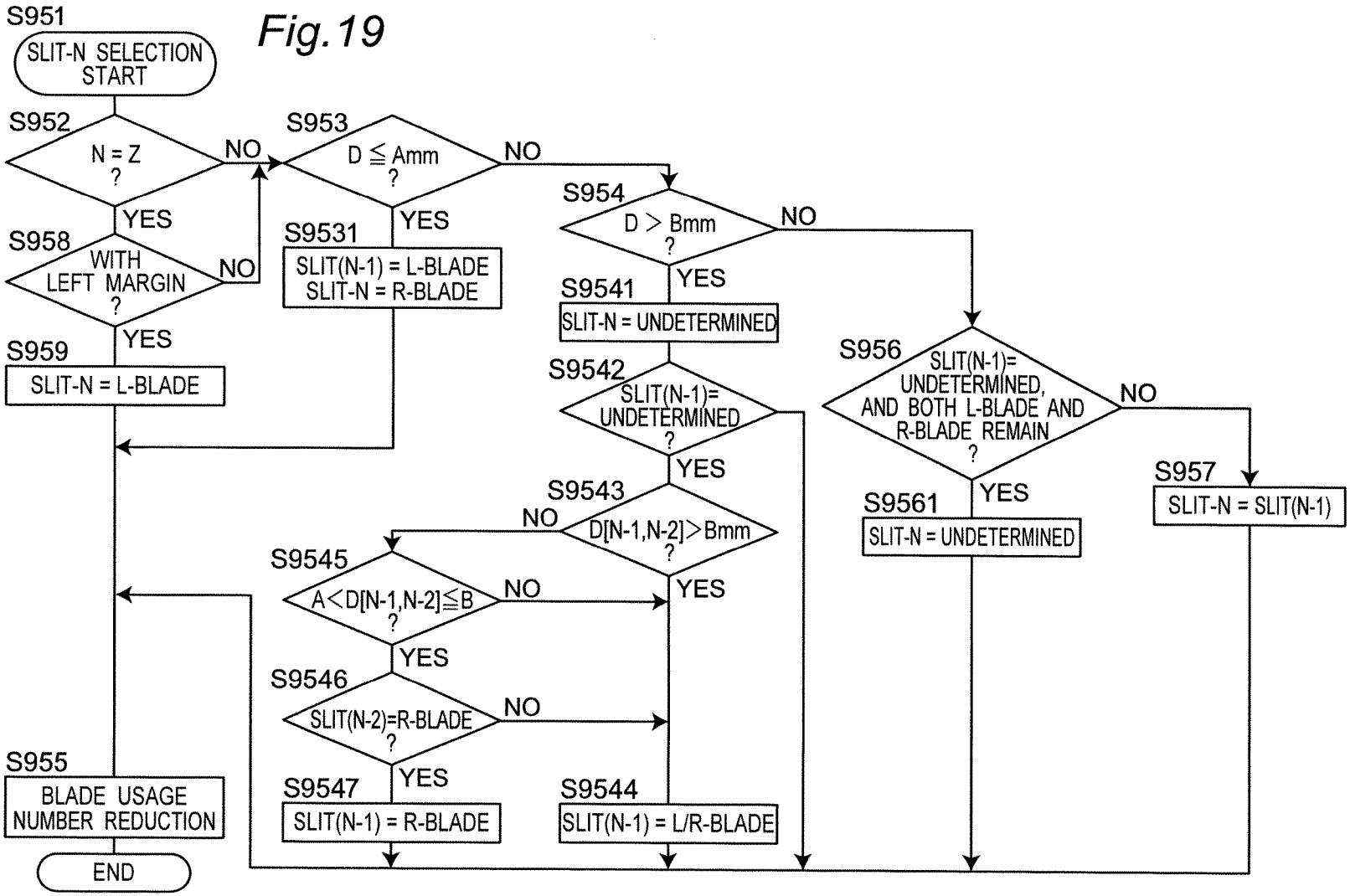
FIG. 19 is a flow chart of selection operation for a slitter at second and subsequent processing positions.

Then, as shown in FIG. 17, when an input of the second processing position X2 is received (S94), selection of the slitter at the second processing position X2 is performed (S95) and hence the operation shown in FIG. 19 is executed. In FIG. 19, when selection of the slitter at the second processing position X2 is started (S951), first, it is judged whether the second processing position X2 is the last processing position (S952).

In the present example, the second processing position X2 is not the last processing position. Thus, the nth judgement part 622 is invoked and judges whether the sheet piece P2 is a scrap (S953). In this case, the judgment is achieved by judging whether the width dimension D of the sheet piece P2 is smaller than or equal to A mentioned above.

In the present example, D(50.0 mm)≥A is satisfied. Thus, the nth α judgment part 6621 is further invoked and judges whether D>B is satisfied (S954).

Here, in the present example, the sheet piece P1 is specified as a scrap. Thus, as for the second processing position X2, setup is performed such that an input satisfying D≤A is restricted. Accordingly, it is always judged as D>A. That is, it is judged that the sheet piece P2 is "not a scrap".

Then, in the present example, D(50.0 mm)>B is satisfied. Thus, the nth α determination part 6622 is invoked and determines that the slitter to be employed at the second processing position X2 is "undetermined" (S9541). Here, in this case, subsequently, it is judged whether the slitter at the first processing position X1 immediately preceding the second processing position X2 is "undetermined" (S9542). In the present example, the slitter at the first processing position X1 has been determined as the right type slitter 71 and hence is not "undetermined". Thus, after that, the slitter remaining number storage part 65 is invoked (S955) but the remaining number is not changed.

Meanwhile, when D≤B is satisfied, the nth β judgment part 6623 is invoked and judges whether the slitter at the first processing position X1 is "undetermined" and whether both the right type slitter 71 and the left type slitter 72 remain (S956). In the case of "undetermined" and "remain", the nth determination part 6624 is invoked and determines that the slitter to be employed at the second processing position X2 is "undetermined" (S9561). In the case of not being "undetermined" or not "remain", the slitter at the first processing position X1 and the slitter at the second processing position X2 are determined to be of the same type (S957). In each case, after that, the slitter remaining number storage part 65 is invoked (S955).

(2-3) Third Processing Position X3

Then, as shown in FIG. 17, when an input of the third processing position X3 is received (S94), selection of the slitter at the third processing position X3 is performed (S95) and hence the operation shown in FIG. 19 is executed. In FIG. 19, when selection of the slitter at the third processing position X3 is started (S951), first, it is judged whether the third processing position X3 is the last processing position (S952).

In the present example, the third processing position X3 is not the last processing position. Thus, the nth judgement part 622 is invoked and judges whether the sheet piece P3 is a scrap (S953). In this case, the judgment is achieved by judging whether the width dimension D of the sheet piece P3 is smaller than or equal to A mentioned above.

In the present example, D(5.0 mm)≤A is satisfied. Thus, the slitter at the third processing position X3 is determined as the right type slitter 71 and the slitter at the second processing position X2 is determined as the left type slitter 72 (S9531). That is, a specification that the sheet piece P3 is regarded as a scrap is performed through the scrap specifying part 6013. After that, the slitter remaining number storage part 65 is invoked and reduces the remaining number of the right type slitters 71 and the remaining number of the left type slitters 72 by one each (S955).

Meanwhile, in the case of D>A, the nth α judgment part 6621 is further invoked and judges whether D>B is satisfied (S954).

(2-4) Fourth Processing Position X4

Then, as shown in FIG. 17, when an input of the fourth processing position X4 is received (S94), selection of the slitter at the fourth processing position X4 is performed (S95) and hence the operation shown in FIG. 19 is executed. In FIG. 19, when selection of the slitter at the fourth processing position X4 is started (S951), first, it is judged whether the fourth processing position X4 is the last processing position (S952).

In the present example, the fourth processing position X4 is not the last processing position. Thus, the nth judgement part 622 is invoked and judges whether the sheet piece P4 is a scrap (S953). In this case, the judgment is achieved by judging whether the width dimension D of the sheet piece P4 is smaller than or equal to the width dimension A.

In the present example, D(50.0 mm)>A is satisfied. Thus, the nth α judgment part 6621 is further invoked and judges whether D>B is satisfied (S954).

Here, in the present example, the sheet piece P3 is specified as a scrap. Thus, as for the fourth processing position X4, setup is performed such that an input satisfying D≤A is restricted. Accordingly, it is always judged as D>A. That is, it is judged that the sheet piece P4 is "not a scrap".

Then, in the present example, D(50.0 mm)>B is satisfied. Thus, the nth α determination part 6622 is invoked and determines that the slitter to be employed at the fourth processing position X4 is "undetermined" (S9541). Here, in this case, subsequently, it is judged whether the slitter at the third processing position X3 immediately preceding the fourth processing position X4 is "undetermined" (S9542). In the present example, the slitter at the third processing position X3 has been determined as the right type slitter 71 and hence is not "undetermined". Thus, after that, the slitter remaining number storage part 65 is invoked (S955) but the remaining number is not changed.

Meanwhile, when D≤B is satisfied, the nth β judgment part 6623 is invoked and judges whether the slitter at the third processing position X3 is "undetermined" and whether both the right type slitter 71 and the left type slitter 72 remain (S956).

(2-5) Fifth Processing Position X5

Then, as shown in FIG. 17, when an input of the fifth processing position X5 is received (S94), selection of the slitter at the fifth processing position X5 is performed (S95) and hence the operation shown in FIG. 19 is executed. In FIG. 19, when selection of the slitter at the fifth processing position X5 is started (S951), first, it is judged whether the fifth processing position X5 is the last processing position (S952).

In the present example, the fifth processing position X5 is not the last processing position. Thus, the nth judgement part 622 is invoked and judges whether the sheet piece P5 is a scrap (S953). In this case, the judgment is achieved by judging whether the width dimension D of the sheet piece P5 is smaller than or equal to A mentioned above.

In the present example, D(5.0 mm)≤A is satisfied. Thus, the slitter at the fifth processing position X5 is determined as the right type slitter 71 and the slitter at the fourth processing position X4 is determined as the left type slitter 72 (S9531). That is, a specification that the sheet piece P5 is regarded as a scrap is performed through the scrap specifying part 6013. After that, the slitter remaining number storage part 65 is invoked and reduces the remaining number of the right type slitters 71 and the remaining number of the left type slitters 72 by one each (S955).

Meanwhile, in the case of D>A, it is judged whether D>B is satisfied (S954).

(2-6) Sixth Processing Position X6

First, as shown in FIG. 17, when an input of the sixth processing position X6 is received (S94), selection of the slitter at the sixth processing position X6 is performed (S95) and hence the operation shown in FIG. 19 is executed. In FIG. 19, when selection of the slitter at the sixth processing position X6 is started (S951), first, it is judged whether the sixth processing position X6 is the last processing position (S952).

In the present example, the sixth processing position X6 is the last processing position. Thus, the Zth judgement part 623 is invoked and judges whether the sheet piece P7 is a scrap (S958). Here, "with a left margin" indicates that the sheet piece at the leftmost end is to be excluded as a scrap.

In the present example, the sheet piece P7 is a scrap. Thus, the slitter at the sixth processing position X6 is determined as the left type slitter 72 (S959). Then, after that, the slitter remaining number storage part 65 is invoked subtracts one from the remaining number of the left type slitters 72 (S955).

Here, at the step of input of the second processing position X2 and at subsequent steps, at each time, as shown in FIG. 17, it is judged whether input of the processing conditions (cutting conditions, in this case) has been completed (S96). Then, in the case of not being completed, input of the subsequent processing positions (S94), determination of the slitters (S95), and judgment of whether input of the processing conditions has been completed (S96) are executed repeatedly. Further, in the case of being completed, selection operation for the slitters at the processing positions where the slitter to be employed is concluded as "undetermined" is executed (S98). However, in the case of absence of a processing position concluded as "undetermined", the selection is terminated.

Figure 20:
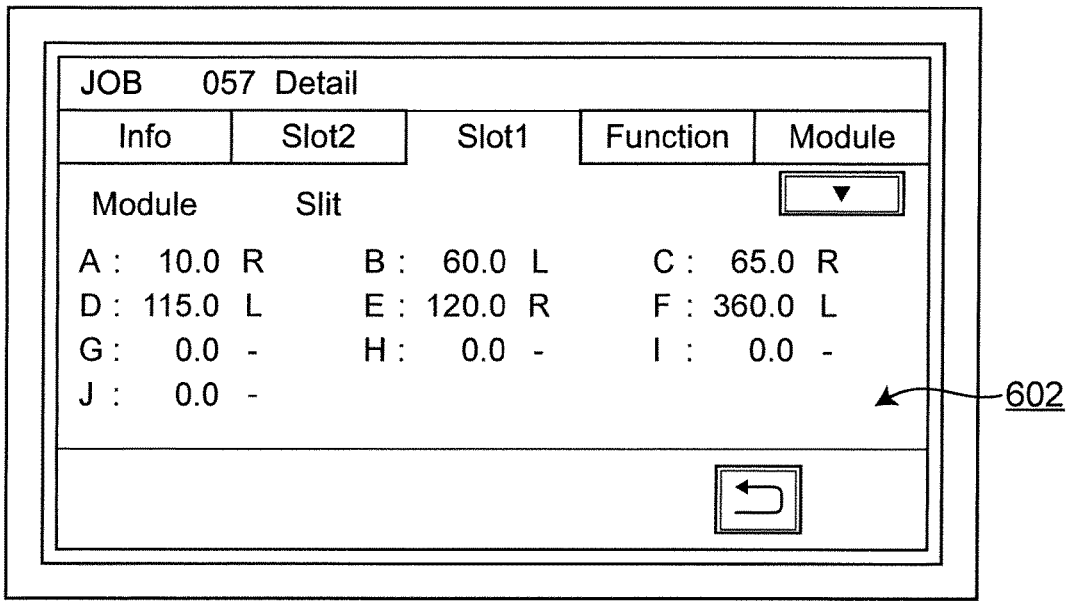
FIG. 20 is a diagram showing a display part on which a selection result is displayed.

As a result of the above-mentioned operation, the slitters to be employed at the first to the sixth processing position X1 to X6 are determined as R-type, L-type, R-type, L-type, R-type, and L-type and then displayed on the display part 602 as shown in FIG. 20.

(Additional Operation 1)

Figure 21:
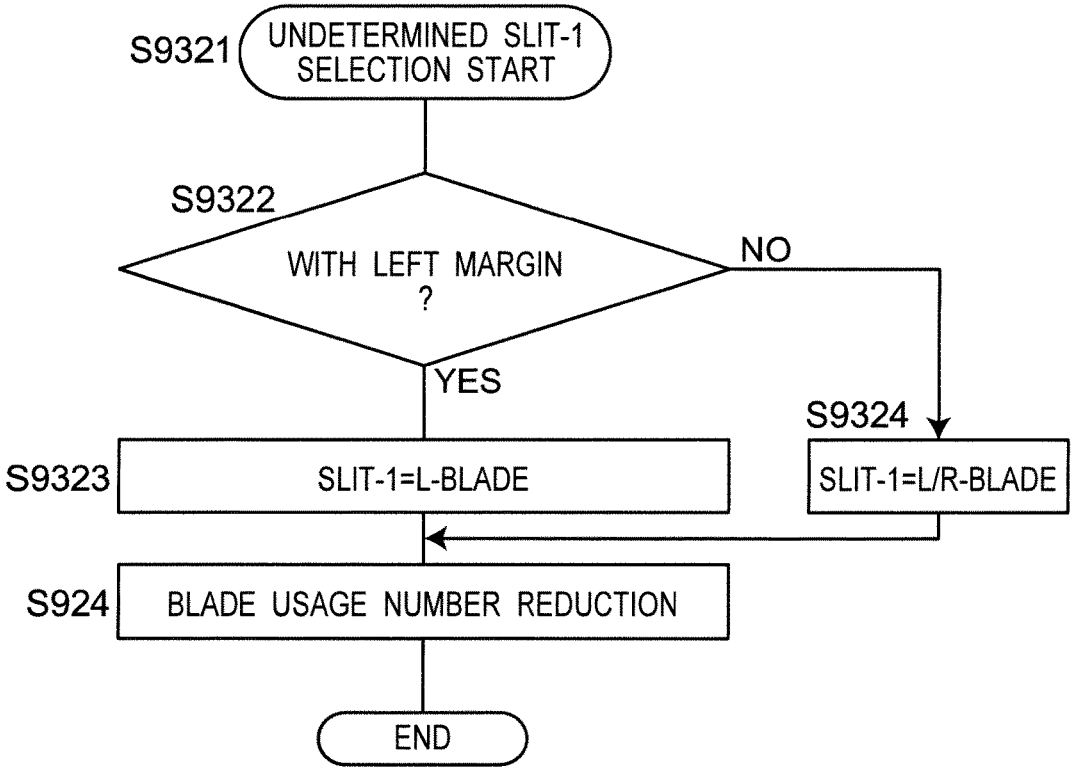
FIG. 21 is a flow chart showing an example of additional operation.

As shown in FIG. 21, in a case that cutting processing is to be performed at one position alone and that the slitter at the first processing position is "undetermined", selection of the undetermined slitter at the first processing position is started (S9321). First, "with or without a left margin" is judged (S9322). In the case of "with a left margin", the slitter is determined as the left type slitter 72 (S9323). In the case of "without a left margin", the slitter is determined as "both the right type slitter 71 and the left type slitter 72 are adoptable" (S9324). Then, in each case, after that, the slitter remaining number storage part 65 is invoked (S924).

(Additional Operation 2)

In the present example, the slitters to be employed at all processing positions have been determined. In contrast, in a case that a processing position is present that the slitter to be employed is concluded as "undetermined", the undetermined slitter settling part 67 is invoked.

Figure 22:
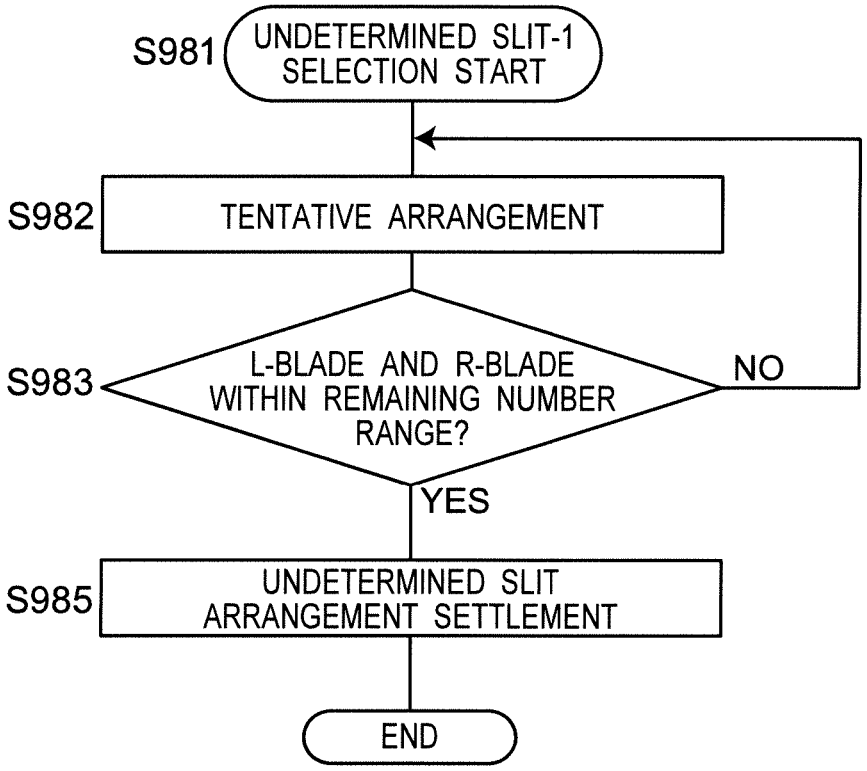
FIG. 22 is a flow chart of operation of an undetermined slitter settling part.

As shown in FIG. 22, when the operation of the undetermined slitter settling part 67 is started (S981), first, the tentative arrangement part 671 is invoked (S982). Then, the tentative arrangement part 671 selects one from three patterns consisting of (i) the right type slitter 71 is adoptable, (ii) the left type slitter 72 is adoptable, and (iii) both the right type slitter 71 and the left type slitter 72 are adoptable as the slitter to be employed at the Nth processing position and having been concluded as "undetermined", and then successively performs tentative arrangement at the "undetermined" Nth processing position. Then, the remain judging part 672 is invoked and judges whether the number of each of the right type slitters 71 and the left type slitters 72 tentatively arranged falls within the range of the remaining number Q (S983). When the judgment result of the remain judging part 672 is "not within the range of the remaining number Q", the tentative arrangement re-invoking part 673 is invoked so that re-invoking of the tentative arrangement part 671 such as to newly perform tentative arrangement (S982) and judgment whether the number of each of the right type slitters 71 and the left type slitters 72 tentatively arranged falls within the range of the remaining number Q (S983) are executed repeatedly. When the judgment result of the remain judging part 672 is "within the range of the remaining number Q", the tentative arrangement settling part 674 is invoked and settles the tentative arrangement (S985). As such, the slitter to be employed at the "undetermined" Nth processing position is selected.

(Additional Operation 3)

In the present example, after the slitter to be employed at the second processing position X2 or the fourth processing position X4 is concluded as "undetermined" (S9541), further, it is judged whether the slitter at the first processing position X1 or the third processing position X3 is "undetermined" (S9542). Then, the slitter at the first processing position X1 or the third processing position X3 has been determined as the right type slitter 71 and, hence, not "undetermined". Thus, after that, the slitter remaining number storage part 65 is invoked (S955).

Nevertheless, in a case that the slitter at the first processing position X1 or the third processing position X3 is "undetermined", that is, in a case that the slitter to be employed at the (N−1)th processing position is "undetermined" at the time of determination of the slitter to be employed at the Nth processing position, the following operation is performed.

First, it is judged whether the width dimension D between the (N−1)th processing position and the (N−2)th processing position is greater than the width dimension B (S9543).

In the case of D>B, the slitter to be employed at the (N−1)th processing position is determined as "both the right type slitter 71 and the left type slitter 72 are adoptable" (S9544). After that, the slitter remaining number storage part 65 is invoked (S955).

In the case of DB, it is judged whether the width dimension D is greater than the width dimension A, that is, whether A<D is satisfied (S9545). In the case that A<D is not satisfied, the procedure goes to S9544 and S955. In the case of A<D, it is judged whether the slitter to be employed at the (N−2)th processing position is the right type slitter 71 (S9546). Then, in the case of "no", the procedure goes to S9544 and S955. In contrast, in the case of "yes", the slitter to be employed at the (N−1)th processing position is determined as the right type slitter 71 (S9547) and then the procedure goes to S955.

(Change of Reference Position)

In the example given above, the right end of the sheet in the width direction has been set as the reference position L by using the reference position setting part 6011. Instead, in a case that the left end of the sheet width direction is desired to be set as the reference position L, each operation shown in FIGS. 18 and 19 is performed in a mode that: the right margin is replaced by the left margin; the left margin is replaced by the right margin; the L-blade is replaced by the R-blade; and the R-blade is replaced by the L-blade, so that the slitter to be employed at each processing position is selected.

(Detailed Configuration of Slitter)

Figure 23:
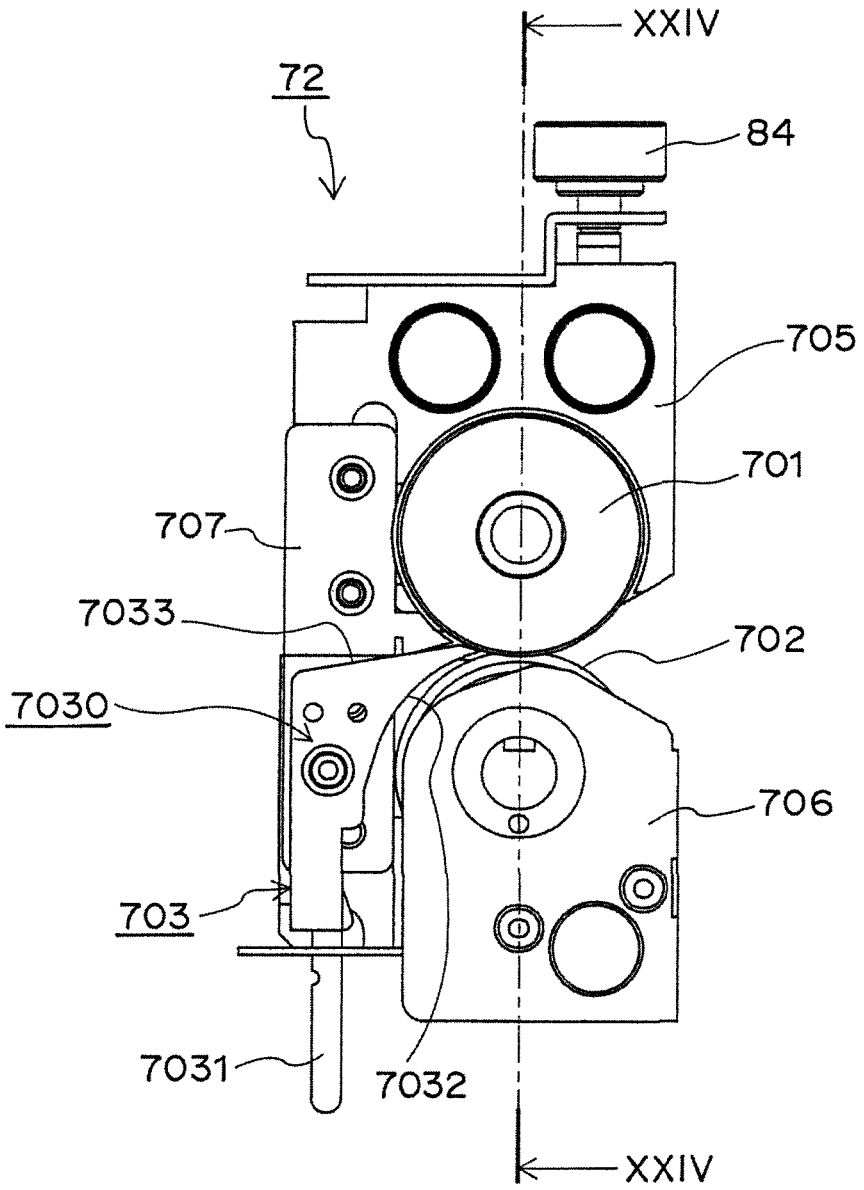
FIG. 23 is a left side view of a left type slitter.
Figure 24:
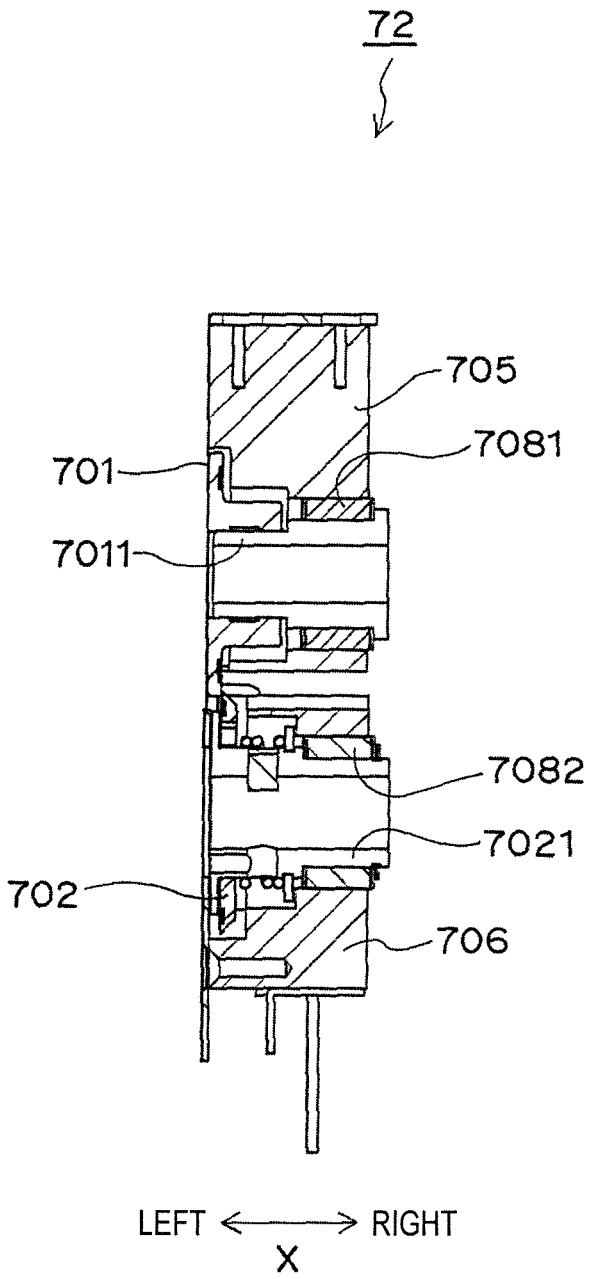
FIG. 24 is a sectional view taken along line XXIV-XXIV in FIG. 23.

FIG. 23 is a left side view of the left type slitter 72. FIG. 24 is a sectional view taken along line XXIV-XXIV in FIG. 23. In the left type slitter 72, the upper rotary blade 701 is held by an upper housing 705 and the lower rotary blade 702 is held by a lower housing 706. The upper housing 705 and the lower housing 706 are formed separately from each other and are integrated together by a link plate 707.

The upper rotary blade 701 is located at the left end of the upper housing 705 and cantilevered. A revolving shaft 7011 of the upper rotary blade 701 is supported by a tube-shaped bearing 7081 in a manner not permitting swing relative to the shaft center so that cantilevered supporting is achieved.

The lower rotary blade 702 is located near the left end of the lower housing 706 and cantilevered. Here, the lower rotary blade 702 is located on the right side of the upper rotary blade 701. A revolving shaft 7021 of the lower rotary blade 702 is supported by a tube-shaped bearing 7082 in a manner not permitting swing relative to the shaft center so that cantilevered supporting is achieved.

Figure 25:
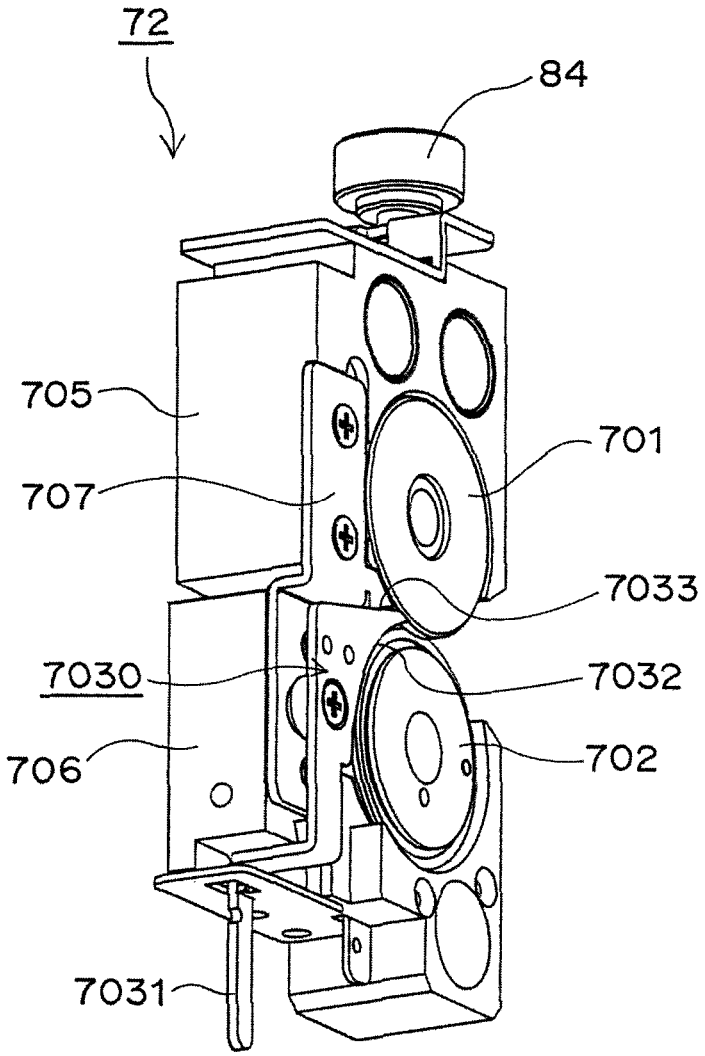
FIG. 25 is a diagram showing a sheet guide in an exclusion mode.
Figure 26:
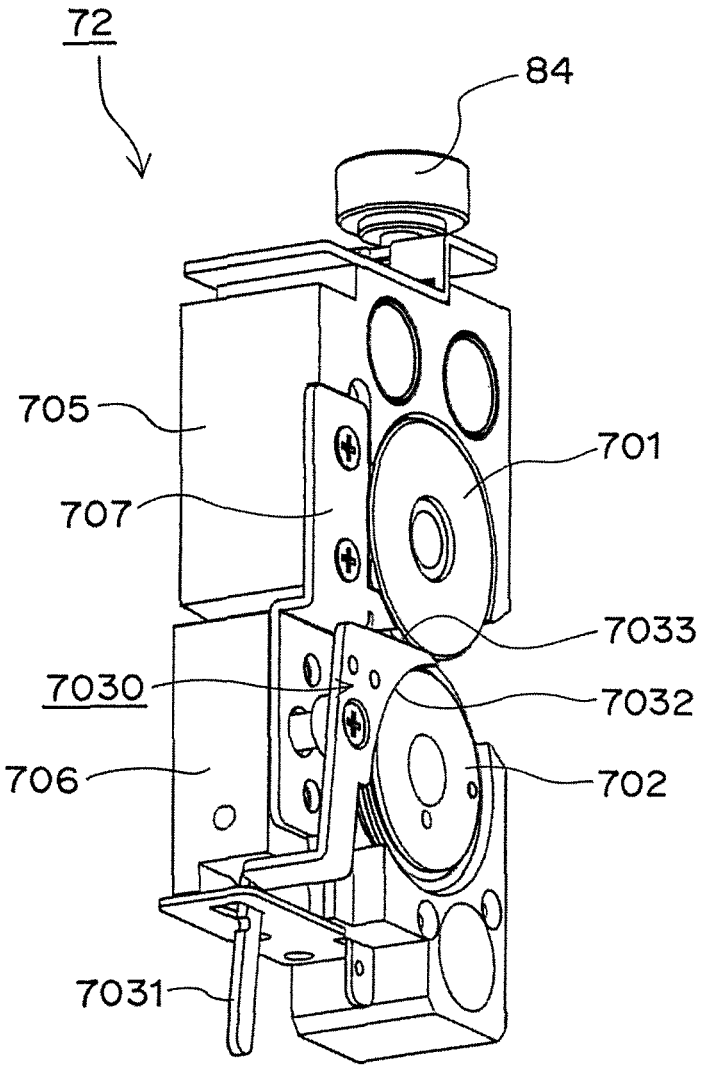
FIG. 26 is a diagram showing a sheet guide in a retreat mode.

Then, in the left type slitter 72, the scrap exclusion member 703 is provided on the left side of the lower rotary blade 702. The scrap exclusion member 703 includes a sheet guide 7030 for going into contact with the sheet piece having been cut and for thereby guiding the sheet piece. When a lever 7031 is operated, the sheet guide 7030 can be displaced between an exclusion mode shown in FIG. 25 and a retreat mode shown in FIG. 26. In the exclusion mode, the sheet piece is guided along a curved surface 7032, that is, while the upper face of the sheet piece is brought into contact with the curved surface 7032, guided in the exclusion direction. In the retreat mode, the sheet piece is guided along an upper plane 7033, that is, while the lower face of the sheet piece is brought into contact with the upper plane 7033, guided in a non-exclusion direction. The non-exclusion direction indicates a direction in which the sheet piece is transported to the downstream in the conveyance direction without being excluded.

Here, the right type slitter 71 has a configuration right-left symmetric to the left type slitter 72.

(State Posterior to Operation)

The slitters which have been determined as described above and which are to be employed at the first to the sixth processing position X1 to X6 are displayed on the display part 602 as shown in FIG. 20. As a result, in the conveyance directional processing part 4, the slitters are arranged as shown in FIG. 27.

Here, in the right type slitter 71 at the first processing position X1, a margin guide 719 is provided on the right side so as to exclude more smoothly and reliably the sheet piece P1 serving as a scrap. Further, in the left type slitter 72 at the sixth processing position X6, a margin guide 729 is provided on the left side so as to exclude more smoothly and reliably the sheet piece P7 serving as a scrap.

Figure 27:
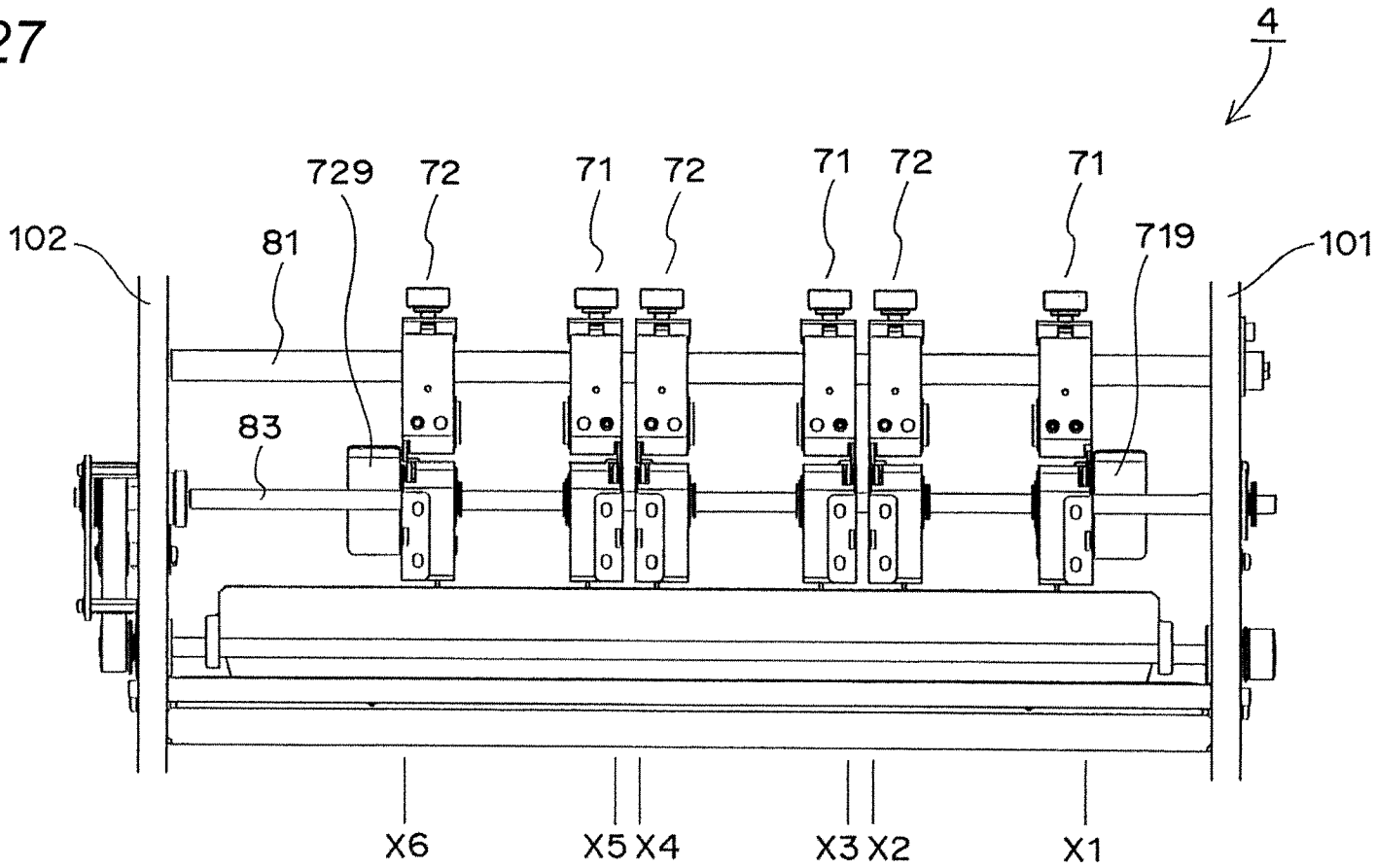
FIG. 27 is a diagram showing a conveyance directional processing part in which selected slitters are arranged.
Figure 28:
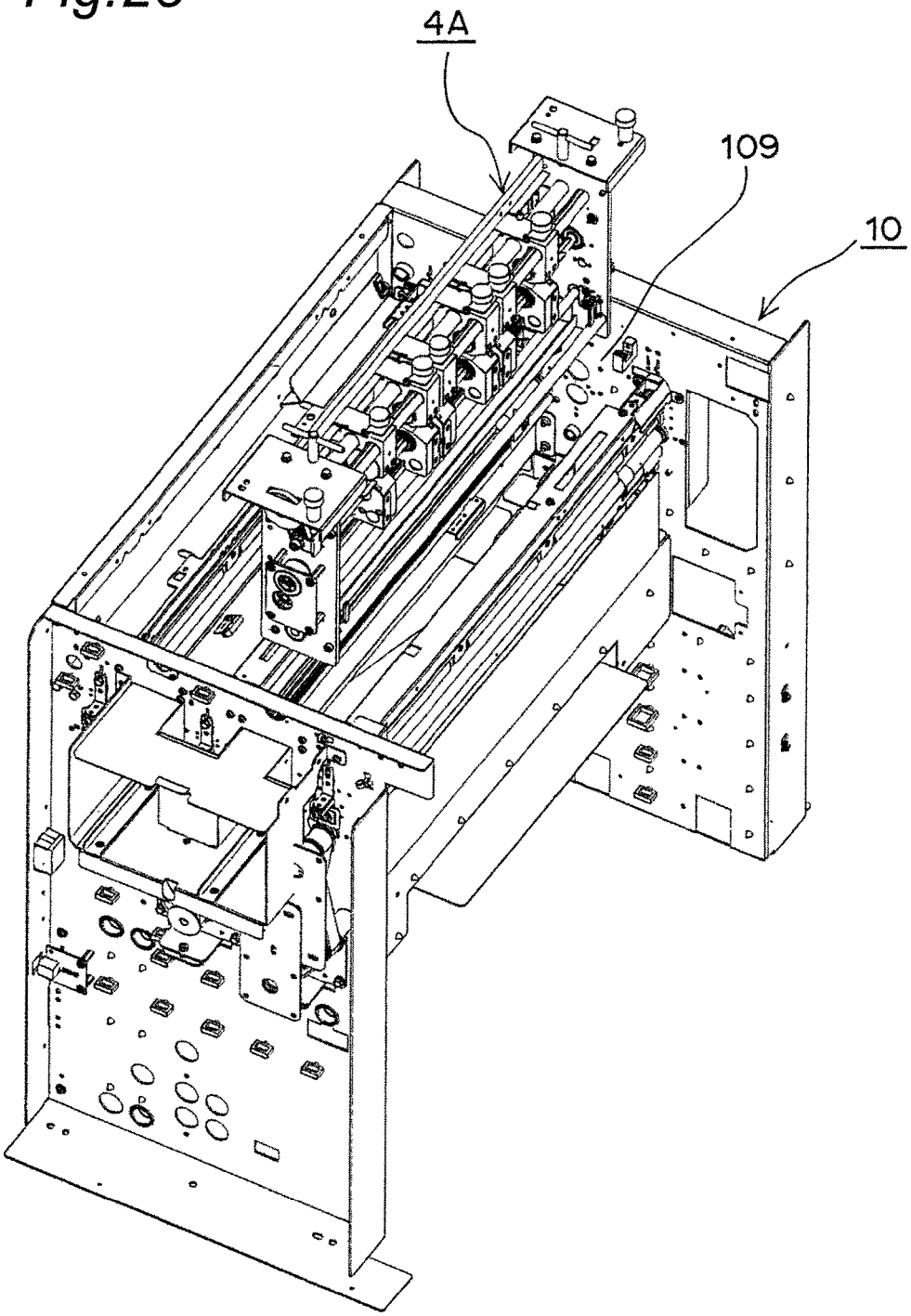
FIG. 28 is a diagram showing a situation that a conveyance directional processing part is freely attachable to and detachable from an apparatus body.

Here, the conveyance directional processing part 4 in FIG. 27 is constructed such that the processing machines are provided directly in the apparatus body 10 by using the side walls 101 and 102 of the apparatus body 10. Alternatively, as shown in FIG. 28, the processing machines may be constructed in the form of a unit 4A and then provided in a freely attachable and detachable manner to and from a receiving part 109 formed in the apparatus body 10.

(Effect)

As described above, according to the sheet processing apparatus of the present embodiment, when the processing conditions concerning the processing contents shown in FIG. 13 or the like are inputted through the input part 601, the slitter selection control part 611 of the processing machine selection control part 61 is invoked so that the type (the right type slitter 71 or the left type slitter 72) of each slitter to be employed at each of the processing positions from the first processing position to the Zth processing position, that is, the types and arrangement of the slitters, can automatically be determined. Further, the determined types and arrangement of the slitters is displayed on the display part 602. Thus, the operator can exchange the slitters with reference to the information displayed on the display part 602. This avoids a situation that a mistake is made in the types and arrangement of the slitters at the time of exchange of the slitters.

Second Embodiment

The first embodiment has been described for an exemplary case that cutting processing alone is performed. Instead, other kinds of processing may be performed in addition to the cutting processing.

Figure 29:
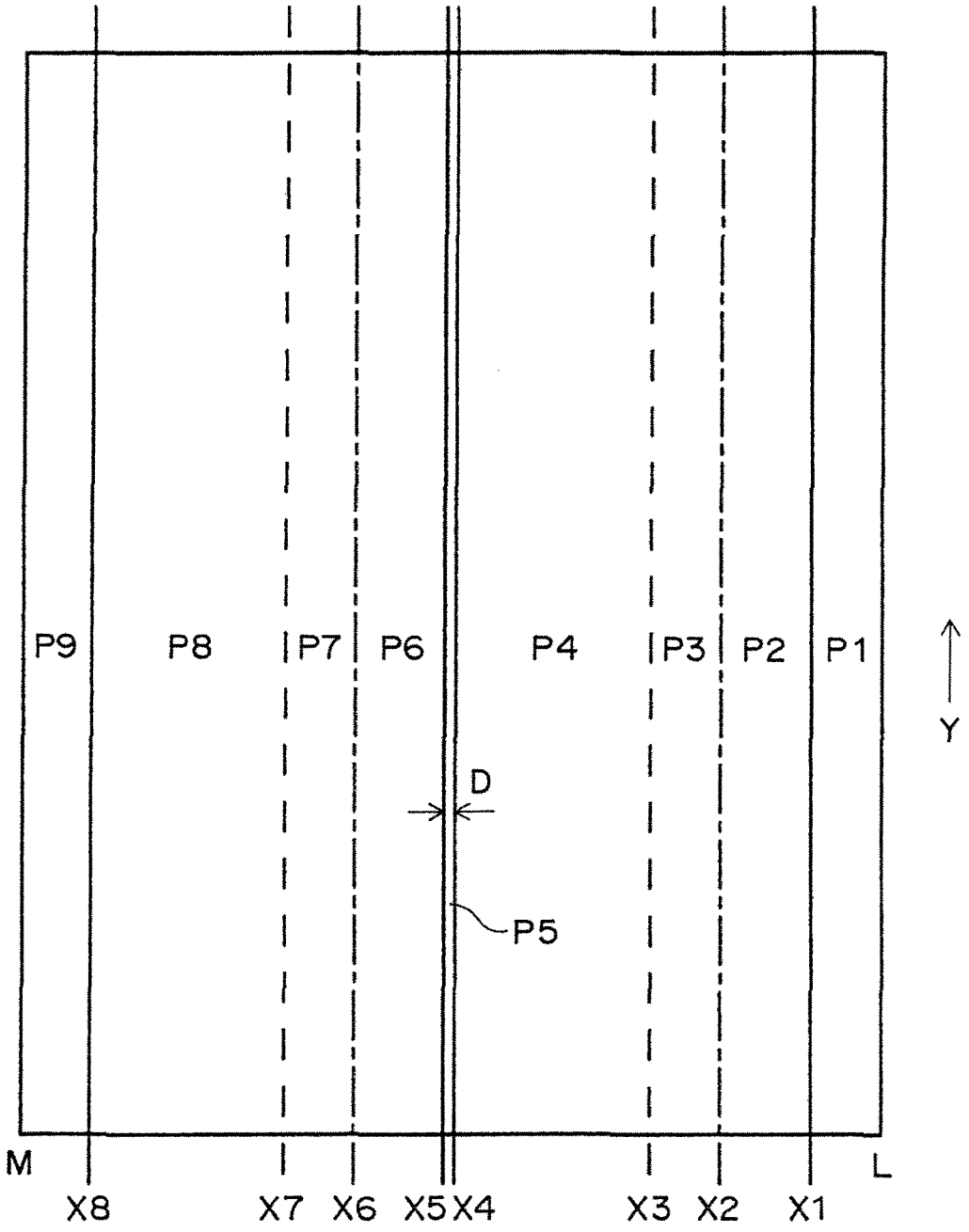
FIG. 29 is an example of processing contents for a sheet of a second embodiment.

(1) FIG. 29 shows an example in which crease processing and perforation line forming processing are performed in addition to the cutting processing. In this case, as the processing conditions, the processing positions and the processing kinds are inputted through the input part 601. First, by using the reference position setting part 6011, the right end of the sheet in the width direction is set as the reference position L. Then, as shown in the display part 602 in FIG. 15, a situation that the sheet piece P1 at the right end (TrimR) is a scrap and a situation that the sheet piece P9 at the left end (TrimL) is a scrap are inputted through the scrap specifying part 6013. Then, the first to the eighth processing position X1 to X8 are set up as width directional distances WN from the reference position L by using the Nth position setting part 6012. That is, specifically, "30.0" mm and cutting processing for the first processing position X1, "65.0" mm and crease processing for the second processing position X2, "100.0" mm and perforation line formation processing for the third processing position X3, "115.0" mm and cutting processing for the fourth processing position X4, "120.0" mm and cutting processing for the fifth processing position X5, "155.0" mm and crease processing for the sixth processing position X6, "190.0" mm and perforation line formation processing for the seventh processing position X7, and "360.0" mm and cutting processing for the eighth processing position X8 are successively inputted. Here, a specification that a sheet piece having a width dimension smaller than a predetermined width dimension A is to be regarded as a scrap is successively inputted through the scrap specifying part 6013. In the processing contents in FIG. 29, the width dimension D of the sheet piece P5 is smaller than the width dimension A. That is, in the processing contents in FIG. 29, the sheet pieces P1, P5, and P9 are excluded as scraps.

(2) Further, at each time that the width directional distance WN of each of the processing positions X1 to X8 is inputted, when the SET 6021 in the display part 602 is pressed by using the input part 601, as shown in FIG. 16, the processing machine selection control part 61 is invoked (S900) and then the slitter selection control part 611 is invoked (S901). The operation of the slitter selection control part 611 is as shown in FIGS. 17 to 19. At that time, processing positions of cutting processing alone are extracted and then selection is performed similarly to the first embodiment. As a result, the slitters to be employed at the first processing position X1, the fourth processing position X4, the fifth processing position X5, and the eighth processing position X8 are selected.

(3) Then, as shown in FIG. 16, the non-slitter selection control part 612 is invoked (S902). Here, the non-slitter selection control part 612 includes: a non-slitter source number storage part for storing a source number Ts indicating the number of processing machines of each type other than the slitter; and a non-slitter remaining number storage part for, at each time that a processing machine other than the slitter is selected, subtracting the selected machine from the source number Ts so as to acquire a remaining number Qs of the processing machines of each type other than the slitter and then storing the acquired value.

Figure 30:
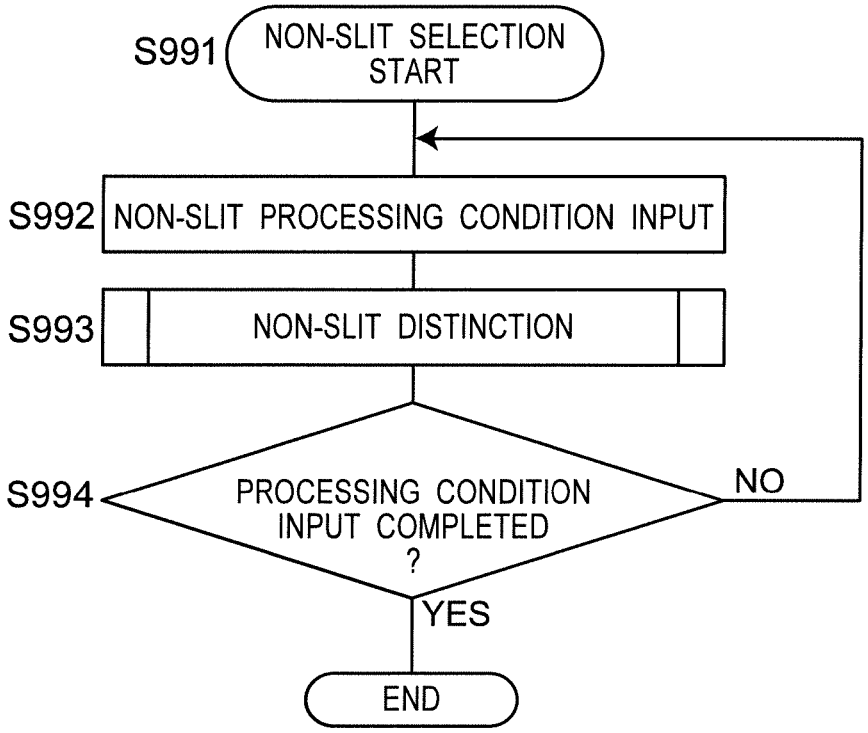
FIG. 30 is a flow chart of operation of a non-slitter selection control part.

As shown in FIG. 30, when the operation of the non-slitter selection control part 612 is started (S991), an input of processing conditions other than cutting processing is received (S992) and then distinction of a processing machine (that is, a non-slitter) other than cutting processing is performed (S993).

Figure 31:
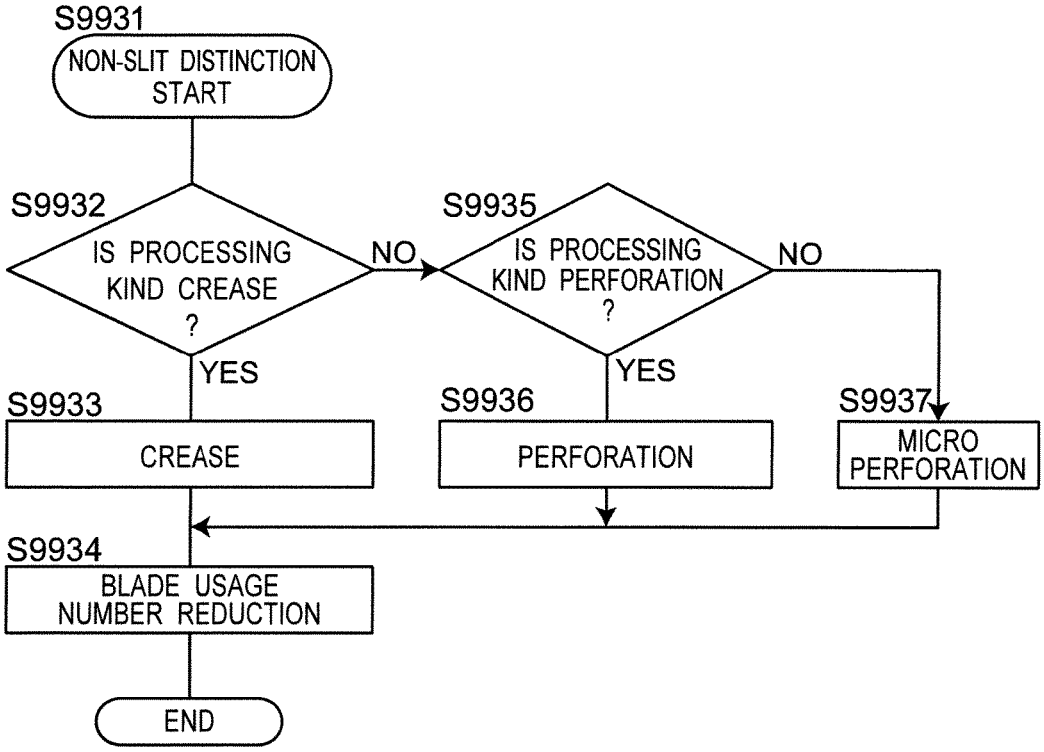
FIG. 31 is a flow chart of operation of distinction of a non-slitter.

As shown in FIG. 31, first, when distinction of the non-slitter is started (S9931), it is judged whether the processing kind at the second processing position X2 is crease (S9932). In the present example, the processing kind is crease. Thus, it is determined that crease is to be performed at the second processing position X2 (S9933). After that, the non-slitter remaining number storage part is invoked (S9934). Then, it is judged whether the processing kind at the third processing position X3 is crease (S9932). In the present example, the processing kind is not crease. Thus, it is judged whether the processing kind at the third processing position X3 is perforation (S9935). In the present example, the processing kind is perforation. Thus, it is determined that perforation is to be performed at the third processing position X3 (S9936). After that, the non-slitter remaining number storage part is invoked (S9934). Then, it is judged whether the processing kind at the sixth processing position X6 is crease (S9932). In the present example, the processing kind is crease. Thus, it is determined that crease is to be performed at the sixth processing position X6 (S9933). After that, the non-slitter remaining number storage part is invoked (S9934). Then, it is judged whether the processing kind at the seventh processing position X7 is crease (S9932). In the present example, the processing kind is not crease. Thus, it is judged whether the processing kind at the seventh processing position X7 is perforation (S9935). In the present example, the processing kind is perforation. Thus, it is determined that perforation is to be performed at the seventh processing position X7 (S9936). After that, the non-slitter remaining number storage part is invoked (S9934). Here, in a case that the processing kind is neither the crease nor the perforation, the processing kind is determined as micro perforation (S9937). After that, the non-slitter remaining number storage part is invoked (S9934).

Here, at the step of input of the second processing position X2 and at subsequent steps, at each time, as shown in FIG. 30, it is judged whether input of the processing conditions of the kinds other than the cutting processing has been completed (S994). Then, in the case of not being completed, input of the subsequent processing position (S992) and determination of the processing machine other than the slitter (S993) are executed repeatedly. Further, in the case of being completed, the selection operation is terminated.

Figure 32:
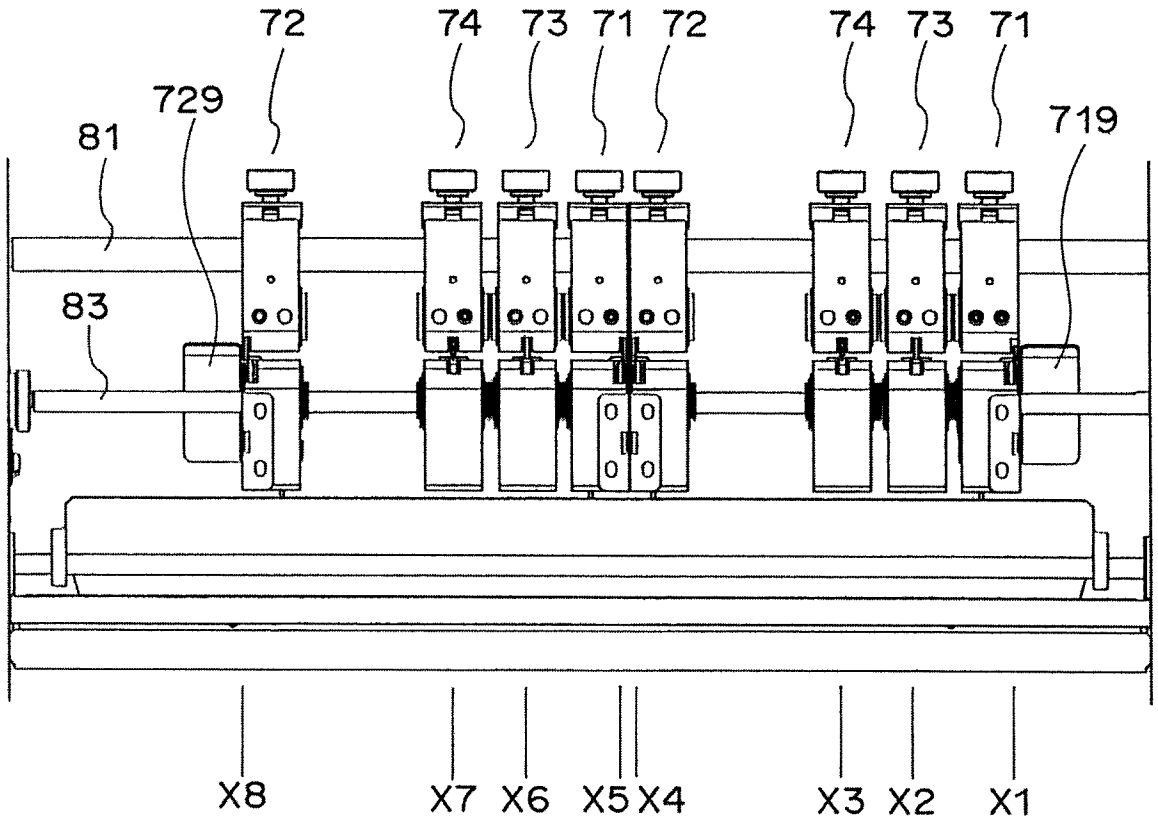
FIG. 32 is a diagram showing a conveyance directional processing part in which selected processing machines are arranged.

As such, the conveyance directional processing part 4 having the arrangement of the processing machines as shown in FIG. 32 is obtained.

As described above, according to the sheet processing apparatus of the present embodiment, when the processing conditions concerning the processing contents shown in FIG. 29 or the like are inputted through the input part 601, the processing machine selection control part 61, that is, the slitter selection control part 611 and the non-slitter selection control part 612 following the former, is invoked and thereby permits automatic determination of the type of the processing machine (the right type slitter 71, the left type slitter 72, the longitudinal crease forming machine 73, the longitudinal perforation line forming machine 75, or the longitudinal micro perforation line forming machine) to be employed at each of processing positions from the first processing position to the Zth processing position, that is, the types and arrangement of the processing machines. Further, the determined types and arrangement of the processing machines is displayed on the display part 602. Thus, the operator can exchange the processing machines with reference to the information displayed on the display part 602. This avoids a situation that a mistake is made in the types and arrangement of the processing machines at the time of exchange of the processing machines.

(Detailed Configuration of Longitudinal Perforation Line Forming Machine)

(1) First Example

Figure 33:
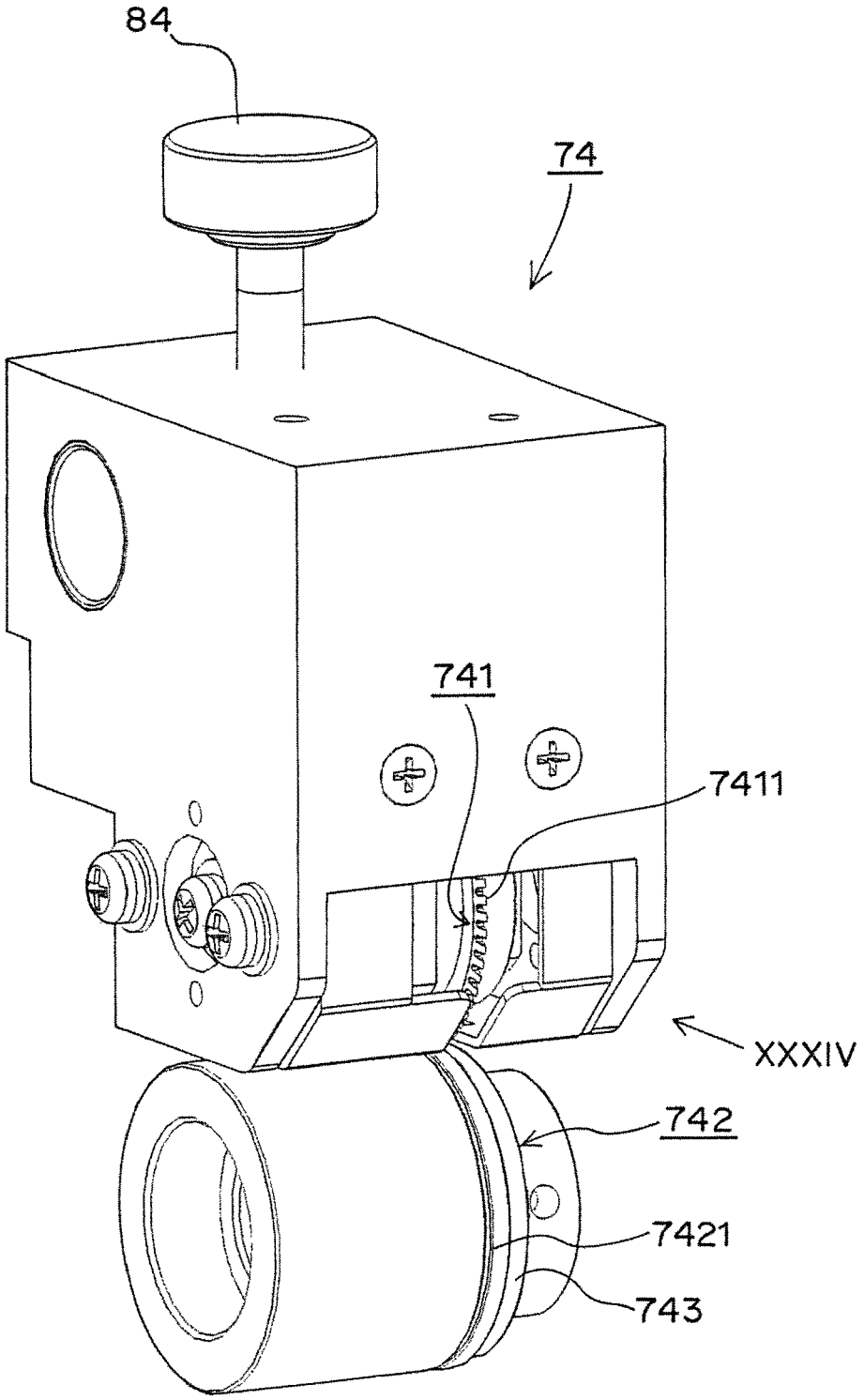
FIG. 33 is a perspective view of a first example of a longitudinal perforation line forming machine.
Figure 34:
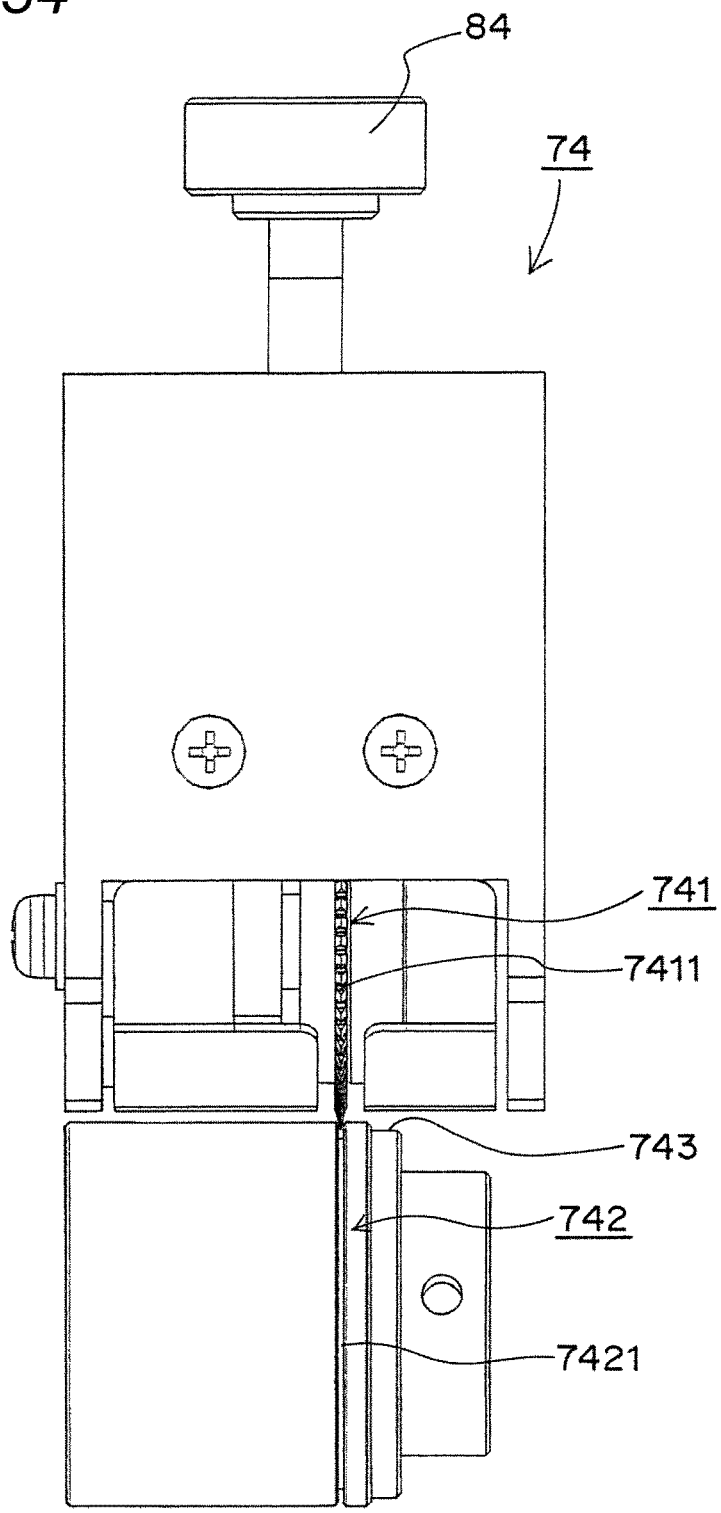
FIG. 34 is a view taken in an arrow XXXIV direction in FIG. 33.

FIG. 33 is a perspective view of the longitudinal perforation line forming machine 74. FIG. 34 is a view taken in an arrow XXXIV direction in FIG. 33. The upper rotary blade 741 constructed from a gear-wheel-shaped blade includes acute angle tip parts 7411 provided in the periphery. The lower rotary blade 742 includes recesses 7421 for accommodating the acute angle tip parts 7411. As shown in FIG. 34, the lower rotary blade 742 includes a plane part 743 provided adjacent to the recesses 7421. The plane part 743 is located at a desired height position of the acute angle tip parts 7411. Thus, in the longitudinal perforation line forming machine 74 of the present example, when the plane part 743 abuts against the upper rotary blade 741, the upper rotary blade 741 can be adjusted to a predetermined reference height.

(2) Second Example

Figure 35:
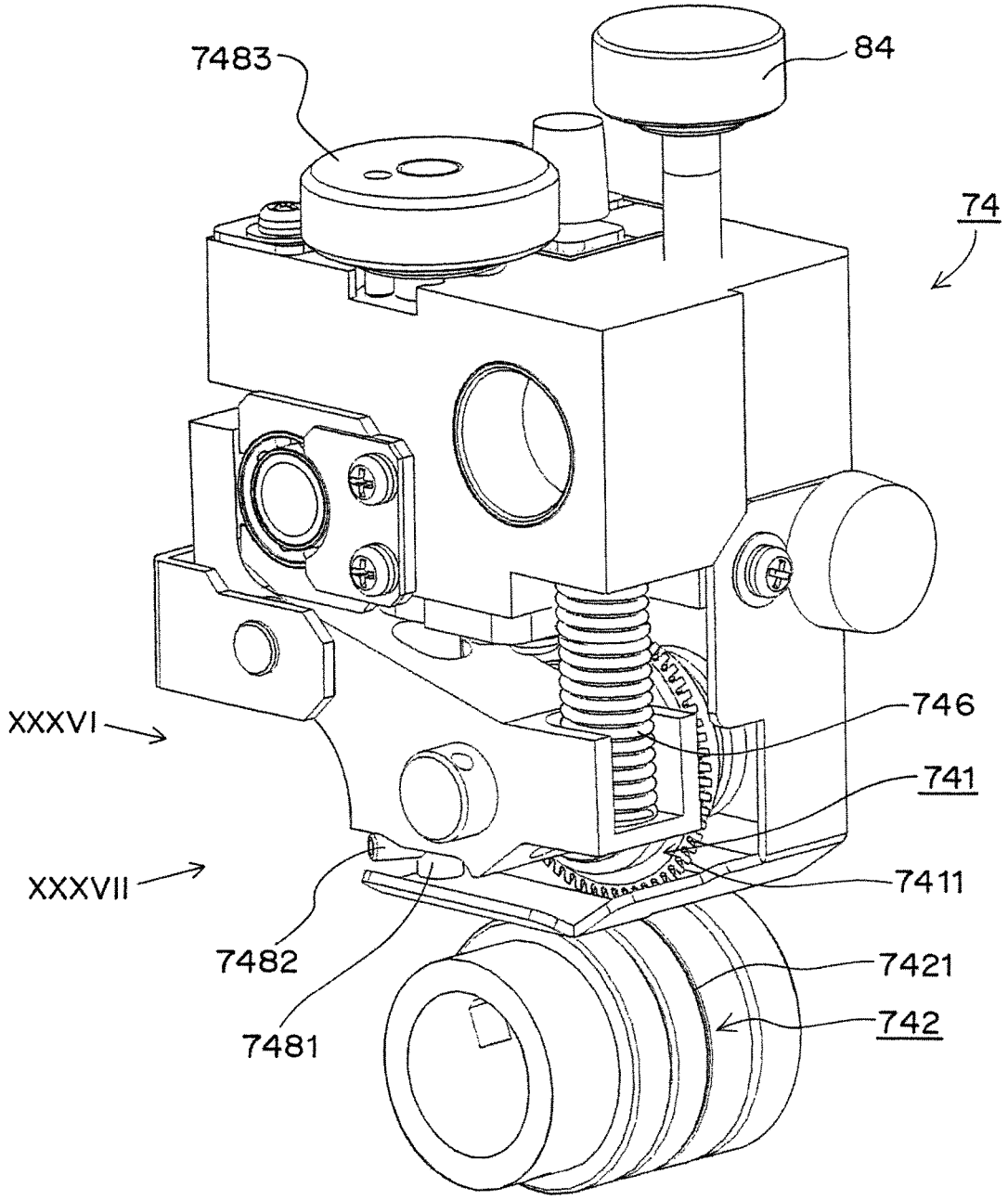
FIG. 35 is a perspective view of a second example of a longitudinal perforation line forming machine.
Figure 36:
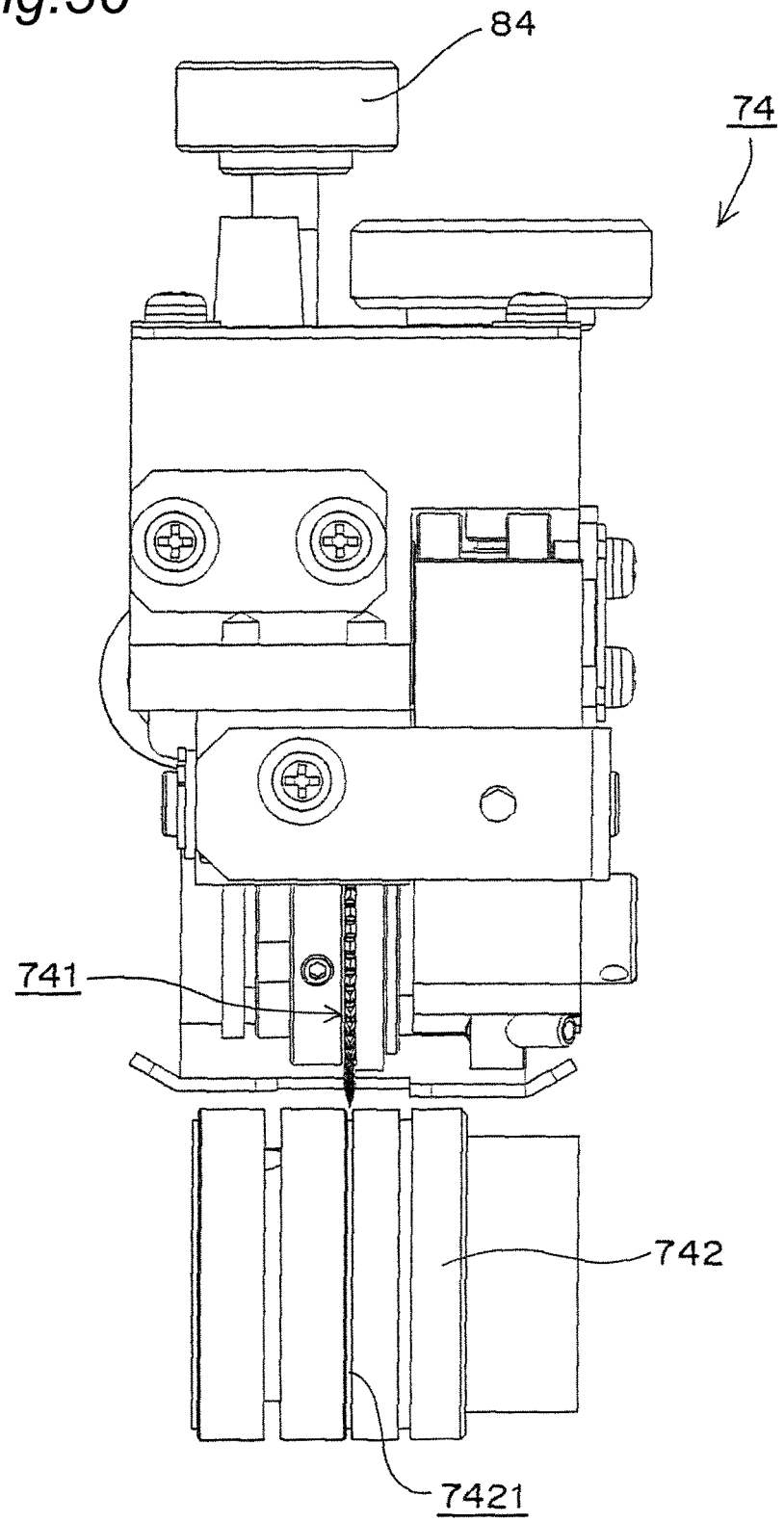
FIG. 36 is a view taken in an arrow XXXVI direction in FIG. 35.
Figure 37:
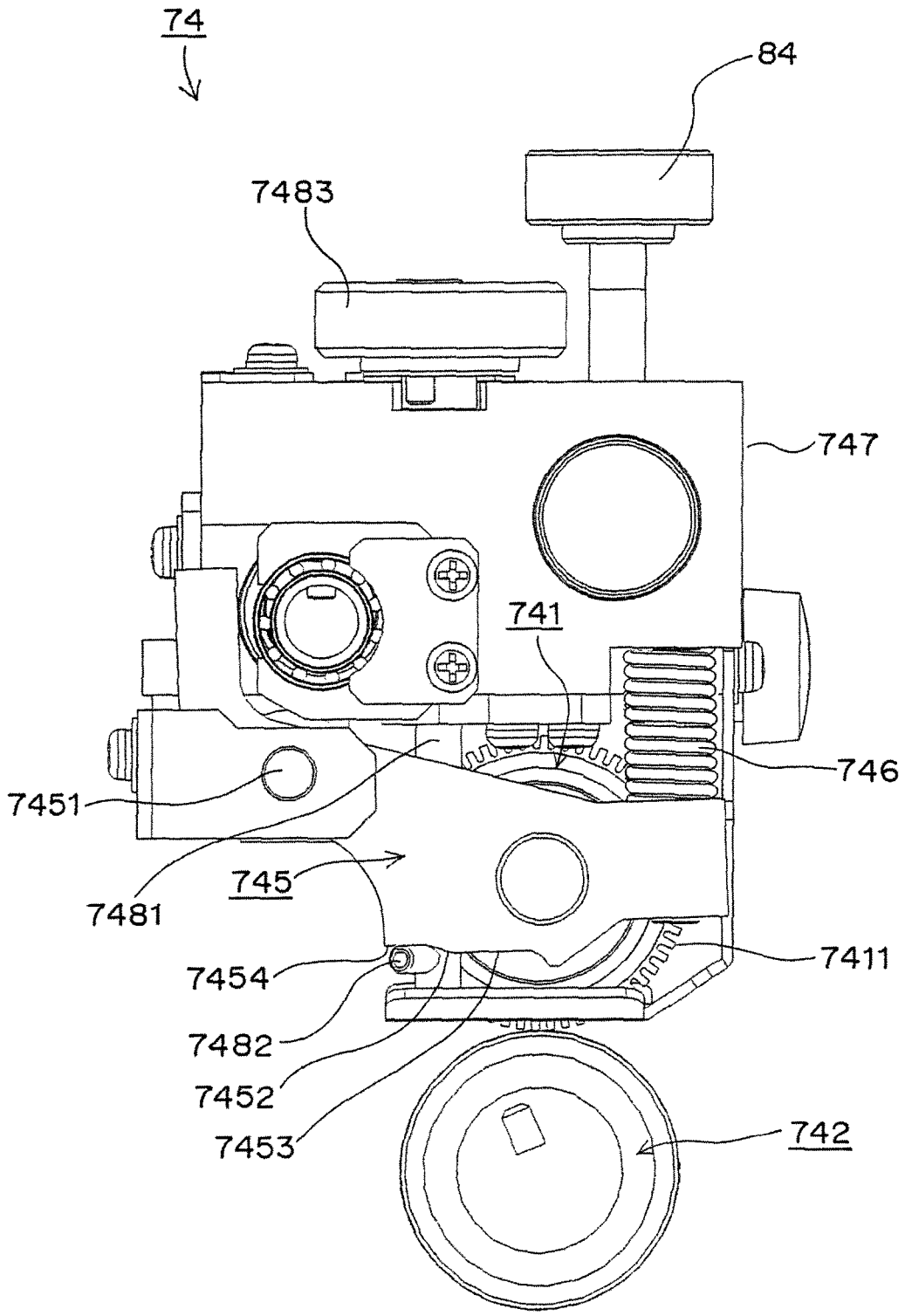
FIG. 37 is a view taken in an arrow XXXVII direction in FIG. 35.

FIG. 35 is a perspective view of the longitudinal perforation line forming machine. FIG. 36 is a view taken in an arrow XXXVI direction in FIG. 35. The upper rotary blade 741 constructed from a gear-wheel-shaped blade includes acute angle tip parts 7411 provided in the periphery. The lower rotary blade 742 includes recesses 7421 for accommodating the acute angle tip parts 7411. As shown in FIG. 37 which is a view taken in an arrow XXXVII direction in FIG. 35, the upper rotary blade 741 is supported by an arm 745. The arm 745 can move up and down by virtue of a pin 7451 serving as a fulcrum. Further, the arm 745 is always biased downward by a spring 746. Then, in the lower edge of the arm 745, a first flat part 7453, an inclined part 7452, and a second flat part 7454 are formed continuously to each other. On the other hand, the housing 747 includes an adjustment pin provided in a freely rotatable manner about a vertical axis. The adjustment pin includes: a threaded rod 7481 screwed into the housing 747; a pin 7482; and a knob 7483. The pin 7482 is provided near the lower end of the threaded rod 7481 in a manner of extending horizontally. Further, the knob 7483 is provided at the upper end of the threaded rod 7481 in a freely rotatable manner within a range smaller than 360 degrees. When the knob 7483 is operated so that the threaded rod 7481 is rotated, the threaded rod 7481 moves forward or retracts in the up and down directions relative to the housing 747. In accordance with this, the pin 7482 is displaced between a first position and a second position via the inclined part 7452. Then, when located in the first position, the pin 7482 abuts against the second flat part 7454 of the arm 745. At that time, in the upper rotary blade 741, the acute angle tip parts 7411 are fit into the recesses 7421 of the lower rotary blade 742 so that a state that perforation can be achieved is realized. In the first position, when the knob 7483 is rotated within a predetermined rotation angle range contained in the rotatable range, the threaded rod 7481 moves forward or retracts and, in accordance with this, the pin 7482 rotates and moves up and down. As a result, the amount of fitting of the acute angle tip parts 7411 into the recesses 7421 can be changed. Further, when located in the second position, the pin 7482 abuts against the first flat part 7453. As a result, the arm 745 has been rotated upward and hence the acute angle tip parts 7411 of the upper rotary blade 741 are located outside the recesses 7421 of the lower rotary blade 742 so that a state that perforation cannot be formed is realized. Thus, according to the longitudinal perforation line forming machine 74 of the present example, when the adjustment pin is operated so that the pin 7482 is rotated, a usage state and a non-usage state of the upper rotary blade 741 can be switched from each other.

Figure 38:
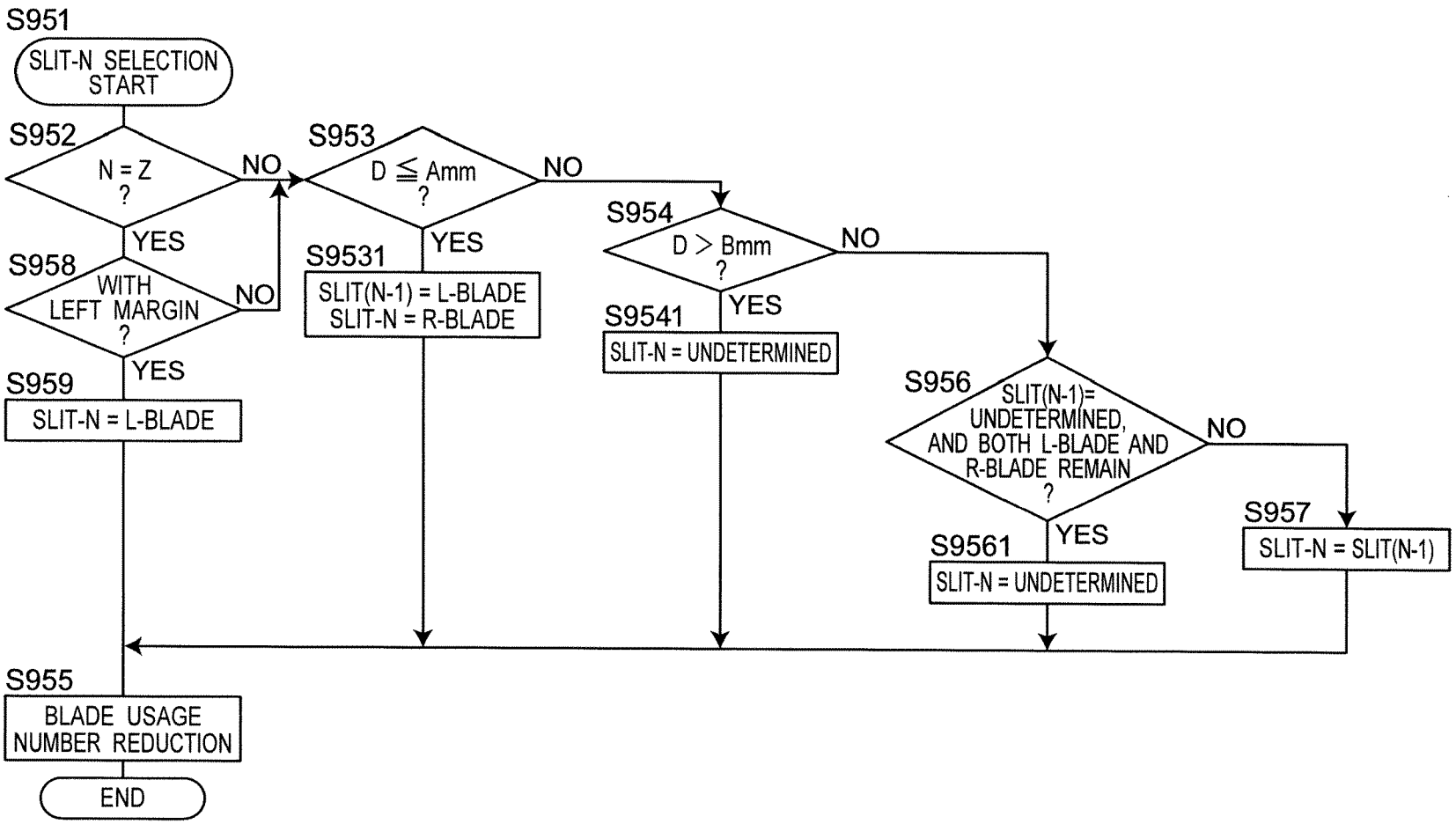
FIG. 38 is a flow chart of another example to a flow chart of FIG. 19.

Other Embodiments (1) Selection of the slitter to be employed at the Nth processing position in a case that N is greater than or equal to 2 may be performed according to the flow chart shown in FIG. 38. In the flow chart of FIGS. 38, S9542 to S9547 are eliminated from the flow chart of FIG. 19. The other points are the same.

(2) In the Nth position setting part 6012, the width directional distance WN from the reference position L is employed. Instead, a width dimension from the (N−1)th processing position may be employed.

(3) The sheet processing apparatus 1 of the present invention may include any other arbitrary processing part in addition to the conveyance directional processing part 4. Further, a plurality of conveyance directional processing parts may be provided at different positions in the conveyance directions. In a case that a plurality of conveyance directional processing parts are to be provided, cutting processing machines (the right type slitters 71 and the left type slitters 72) may be provided in one conveyance directional processing part and then processing machines other than the cutting processing machine (the longitudinal crease forming machines 73, the longitudinal perforation line forming machines 74, the longitudinal micro perforation line forming machines, and the like) may be provided in the other conveyance directional processing parts.

(4) The input part 601 may be provided not in the operation panel 60 constructed integrally with the apparatus body 10 but in an external terminal such as a personal computer and a portable terminal.

(5) The display part 602 may be provided not in the operation panel 60 constructed integrally with the apparatus body 10 but in an external terminal such as a personal computer and a portable terminal. Further, the display part 602 may be provided not integrally with but separately from the input part 601.

(6) The reference position setting part 6011 may be not provided. In this case, any one alone of the right end and the left end in the sheet width direction may be adopted as the reference position and then stored in advance as an invariant into a storage part (not shown) of the control part 6. Here, in this case that the any one has been stored as the reference position, the alternatives listed in the given-above embodiments and selected when the other one is adopted as the reference position are not to be selected. Thus, such alternatives are unnecessary.

(7) The processing machine selection control part 61 may include: the slitter source number storage part 64; a slitter usage number storage part for, at each time that the right type slitter 71 or the left type slitter 72 is selected by the slitter selecting part 63, acquiring and storing a total number V of each of the right type slitters 71 and the left type slitters 72 having been selected; and a slitter settling part for comparing the source number T and the total number V with each other and then, when T>V is satisfied for the right type slitters 71, determining the "right type slitter 71" as the slitter to be employed and, when T>V is satisfied for the left type slitters 72, determining the "left type slitter 72" as the slitter to be employed. Here, in this case, the slitter determining part 66 and the undetermined slitter settling part 67 may not operate. However, in a case that these parts operate, the nth β judgment part 6623 of the slitter determining part 66 judges whether the slitter to be employed at the (n−1)th processing position is "undetermined" and T>V is satisfied when the source number T and the total number V are compared with each other. Further, the remain judging part 672 of the undetermined slitter settling part 67 judges whether a tentative total number Vs obtained by adding to the total number V the number of each of the right type slitters 71 and the left type slitters 72 tentatively arranged is smaller than the source number T.

(8) In the conveyance directional processing part provided in the sheet processing apparatus of the present invention, when a configuration is employed that a plurality of processing machines of two or more types can be provided and aligned in the width direction, a configuration is not excluded that a plurality of processing machines of one type selected from the two or more types of processing machines are provided and aligned in the width direction.

Figure 39:
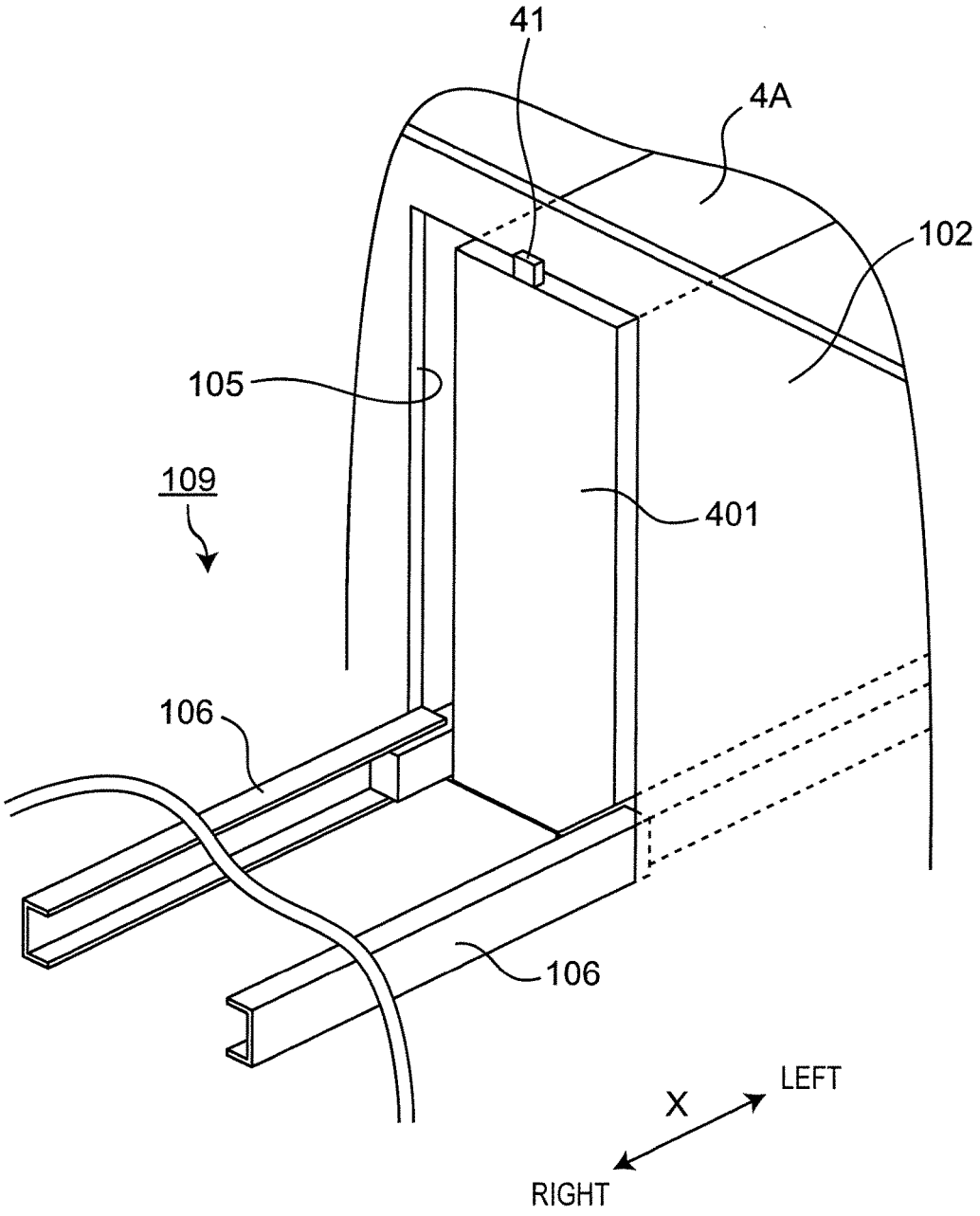
FIG. 39 is a perspective part view showing another example of a freely attachable and detachable configuration of a unit.

(9) In FIG. 28, the unit 4A is provided in a freely attachable and detachable manner to and from the receiving part 109 from the above of the apparatus body 10. Instead, as shown in FIG. 39, the unit 4A may be provided in a freely attachable and detachable manner to and from the receiving part 109 in a horizontal direction through an opening 105 formed in one side wall 102 (or the side wall 101) selected from the side walls 101 and 102 of the apparatus body 10. For example, in FIG. 39, a pair of rail members 106 are provided that extend through the opening 105. Then, the unit 4A is slid along the rail members 106 and then pulled out through the opening 105.

(10) In FIG. 28, the unit 4A is provided in such a manner that the unit 4A can completely be removed from the apparatus body 10. Instead, the unit 4A may be provided in such a manner that the unit 4A cannot completely be removed from the apparatus body 10. For example, in the example of FIG. 39, a protrusion (a locking member) 41 is provided at an upper end of a right side plate 401 of the unit 4A. Then, when the unit 4A is to be pulled out through the opening 105, the protrusion 41 interferes with the side wall 102. Thus, the unit 4A is not completely pulled out through the opening 105 and is held on the rail members 106 in a half pulled out state.

(11) In the example of FIG. 39, the protrusion 41 may be provided in a freely attachable and detachable manner or, alternatively, may be provided in a freely movable manner between a position where the protrusion 41 interferes with the side wall 102 and a position where the interference does not occur. According to this configuration, when necessary, the protrusion 41 may be removed or, alternatively, the protrusion 41 may be moved to a position where the interference does not occur so that the unit 4A can completely be pulled out through the opening 105.

Figure 40:
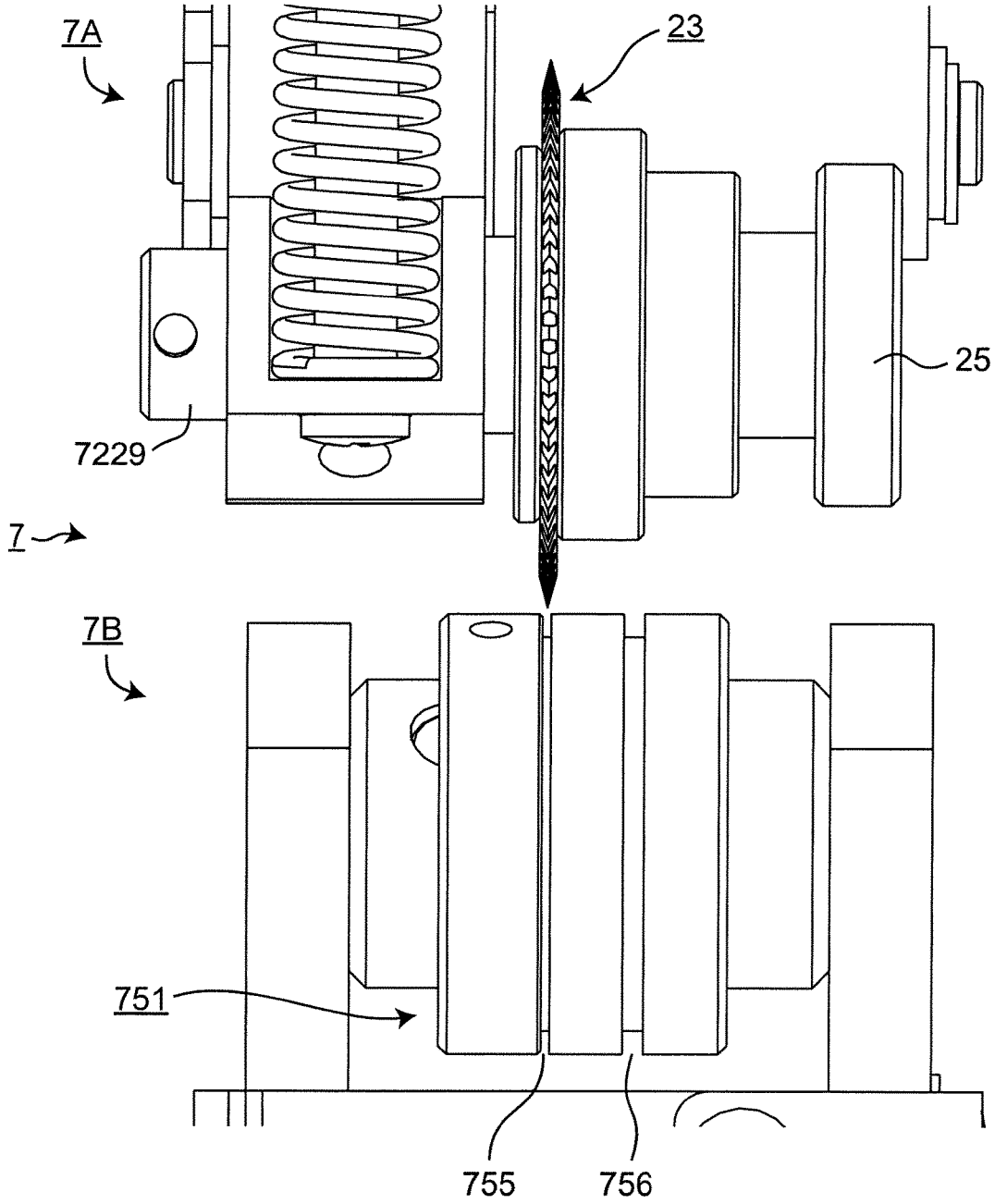
FIG. 40 is a main part enlarged view of a processing machine of another example.
Figure 41:
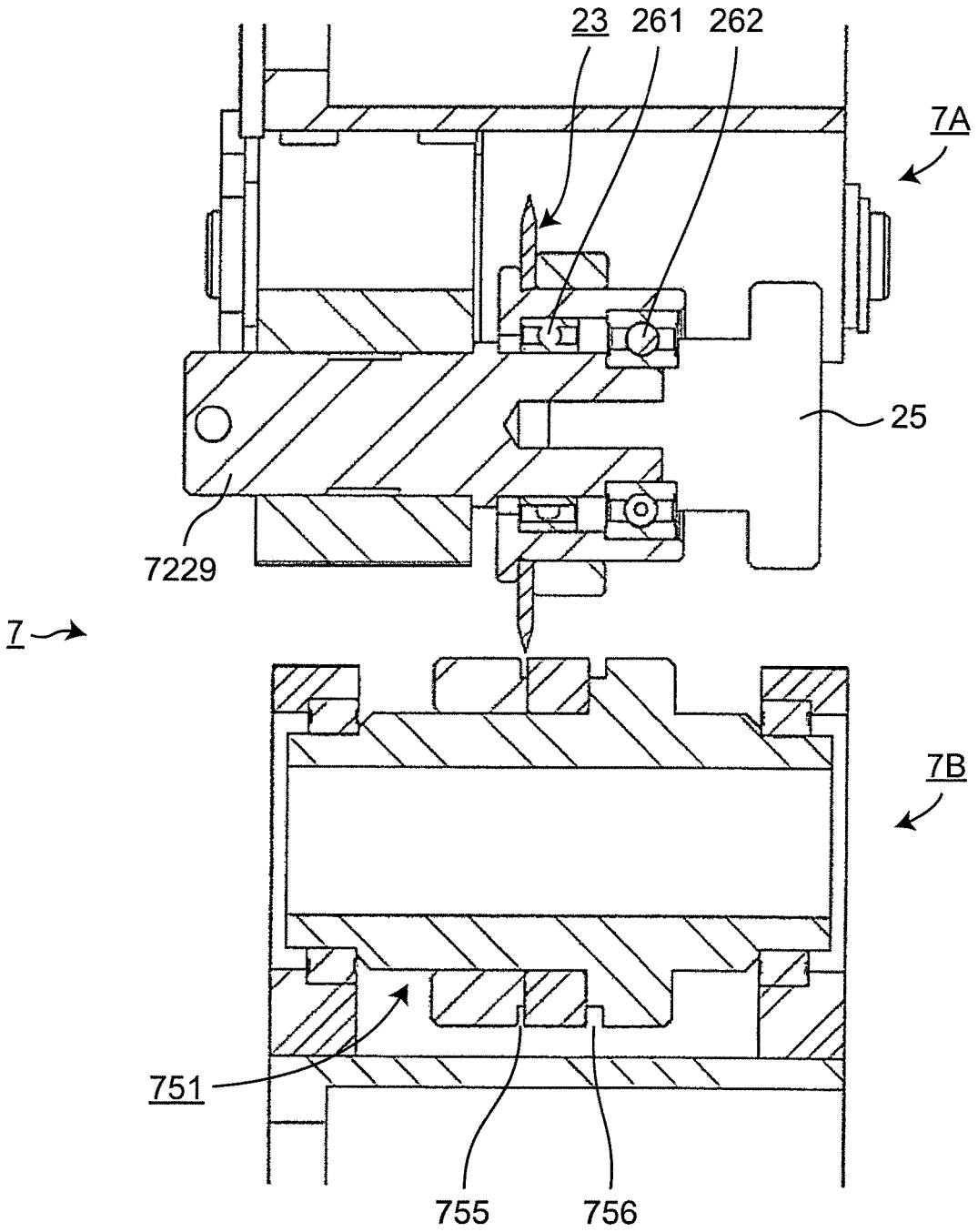
FIG. 41 is a longitudinal sectional view of a main part shown in FIG. 40.
Figure 42:
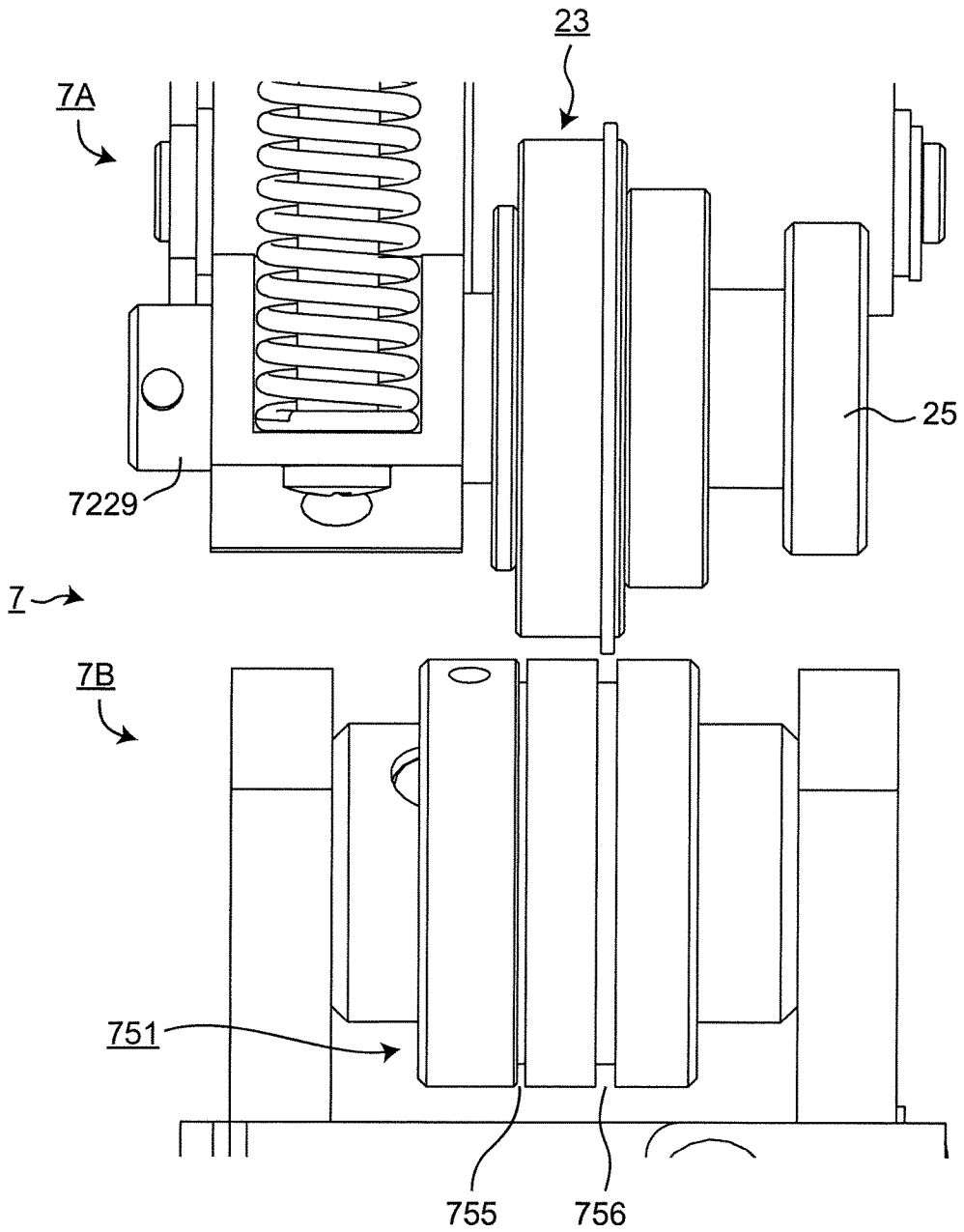
FIG. 42 is a main part enlarged view of a processing machine of another example.
Figure 43:
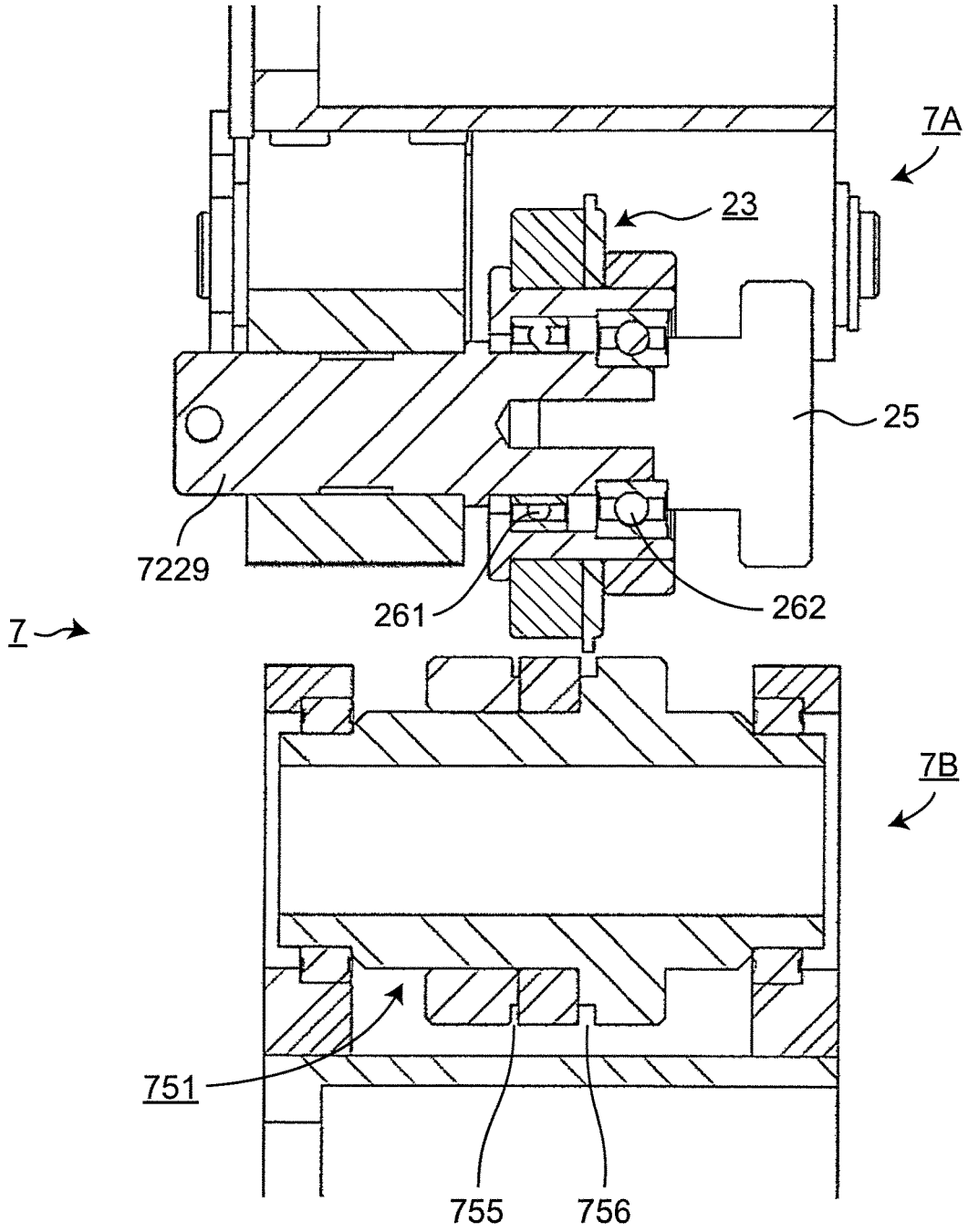
FIG. 43 is a longitudinal sectional view of a main part shown in FIG. 42.

(12) The processing machine 7 may be constructed such that the processing blade itself can be exchanged. That is, when the processing machine 7 is to be exchanged, in place of exchanging the entire processing machine 7, the processing blade alone of the processing machine 7 may be exchanged. Here, the processing blade indicates the upper rotary blade 701, 731, 741, or the like. Specific examples are described below with reference to FIGS. 40 to 43. FIG. 40 is a main part enlarged view of the processing machine 7. The processing blade 23 is a perforation blade. FIG. 41 is a longitudinal sectional view of the main part shown in FIG. 40. FIG. 42 is a main part enlarged view of the processing machine 7. The processing blade 23 is a crease blade. FIG. 43 is a longitudinal sectional view of the main part shown in FIG. 42. In the processing machine 7, the processing blade 23 is fit through bearings 261 and 262 onto a shaft 7229 supported by a upper body 7A in a manner permitting revolution and, then, is attached by a fastener 25 screwed into the shaft 7229. Thus, when the fastener 25 is removed, the processing blade 23 can be exchanged on the shaft 7229 with another processing blade. That is, the processing blade 23 constructed from a perforation blade in FIG. 40 can be exchanged into the processing blade 23 constructed from a crease blade, as shown in FIG. 42. Here, a receiving member 751 in a lower body 7B of the processing machine 7 is provided with at least: a first receiving part 755 corresponding to the perforation blade; and a second receiving part 756 corresponding to the crease blade.

INDUSTRIAL APPLICABILITY

In the sheet processing apparatus of the present invention, the types and arrangement of the processing machines to be provided in the conveyance directional processing part can automatically be determined. This avoids a situation that a mistake is made in the types and arrangement of the processing machines at the time of exchange of the processing machines. Accordingly, a high value is obtained in industrial utilization.

DESCRIPTION OF REFERENCE NUMERALS

1 Sheet processing apparatus
4 Conveyance directional processing part
4A Unit
61 Processing machine selection control part
601 Input part
602 Display part
6011 Reference position setting part
6012 Nth position setting part
6013 Scrap specifying part
62 Scrap judging part
621 First judgement part
622 nth judgement part
623 Zth judgement part
63 Slitter selecting part
631 First selection part
632 nth selection part
633 Zth selection part
64 Slitter source number storage part
65 Slitter remaining number storage part
66 Slitter determining part
661 First determination part
662 nth determination part
6621 nth α judgment part
6622 nth α determination part
6623 nth β judgment part
6624 nth β determination part
6625 nth γ determination part
67 Undetermined slitter settling part
671 Tentative arrangement part
672 Remain judging part
673 Tentative arrangement re-invoking part
674 Tentative arrangement settling part
7 Processing machine
701 Upper rotary blade
702 Lower rotary blade
703 Scrap exclusion member
7030 Sheet guide
71 Right type slitter
72 Left type slitter
100 Sheet

What is claimed is:

1. A sheet processing apparatus for processing a sheet in the course of conveyance of the sheet, comprising:

a conveyance directional processing part for performing processing along the conveyance direction onto the sheet, the conveyance directional processing part being constructed such that at the same position in the conveyance direction, a plurality of processing machines of two or more types are aligned in a width direction perpendicular to the conveyance direction and provided in a freely attachable and detachable manner;

a condition input part through which processing conditions in the conveyance directional processing part are inputted;

a display part for displaying the processing conditions; and a processing machine selection control part for acquiring types and arrangement of the processing machines to be provided in the conveyance directional processing part such that the processing conditions are satisfied and then displaying the acquired types and arrangement on the display part;

wherein:

the conveyance directional processing part is constructed such that first processing machines and second processing machines of different types from each other are provided in a predetermined number Z in total;

the first processing machine is a right type slitter comprising an upper rotary blade and a lower rotary blade held by a housing, the right type slitter is constructed such that the upper rotary blade is located on a right side of the lower rotary blade in the width direction and both the upper rotary blade and the lower rotary blade are located on the right side of the housing in the width direction; and the second processing machine is a left type slitter comprising an upper rotary blade and a lower rotary blade held by a housing, the left type slitter is constructed such that the upper rotary blade is located on a left side of the lower rotary blade in the width direction and both the upper rotary blade and the lower rotary blade are located on the left side of the housing in the width direction; and each of the first processing machine and the second processing machine is constructed such that the upper rotary blade and the lower rotary blade revolve in a manner of being lapped together so that cutting processing is performed on the sheet.

2. The sheet processing apparatus according to claim 1, wherein

N mentioned below is an integer greater than or equal to 1 and smaller than or equal to Z mentioned above, wherein the condition input part includes:

an Nth position setting part for setting an Nth processing position defined as an Nth cutting position counted from a reference position which is a right end or a left end of the sheet in the width direction and/or a scrap specifying part for specifying a sheet piece to be excluded as a scrap, wherein the processing machine selection control part includes:

a scrap judging part for judging whether the sheet piece formed on the reference position side or a counter-reference position side of the Nth processing position is a scrap; and a slitter selecting part for, when the judgment result of the scrap judging part is "a scrap", selecting any one of the right type slitter and the left type slitter as the slitter to be employed at the Nth processing position, and wherein the slitter selecting part is adapted to:

when the judgment result of the scrap judging part is "the sheet piece on the reference position side is a scrap" and the reference position is the right end, select the right type slitter as the slitter to be employed at the Nth processing position, when the judgment result of the scrap judging part is "the sheet piece on the reference position side is a scrap" and the reference position is the left end, select the left type slitter as the slitter to be employed at the Nth processing position, when the judgment result of the scrap judging part is "the sheet piece on the counter-reference position side is a scrap" and the reference position is the right end, select the left type slitter as the slitter to be employed at the Nth processing position, and when the judgment result of the scrap judging part is "the sheet piece on the counter-reference position side is a scrap" and the reference position is the left end, select the right type slitter as the slitter to be employed at the Nth processing position.

3. The sheet processing apparatus according to claim 2, wherein the condition input part further includes a reference position setting part for setting as the reference position the right end or the left end of the sheet in the width direction.

4. The sheet processing apparatus according to claim 2, wherein the processing machine selection control part includes a slitter determining part for, when the judgment result of the scrap judging part is "the sheet piece on the reference position side is not a scrap", determining that the slitter to be employed at the Nth processing position is "undetermined" or of the same type as the slitter to be employed at the (N−1)th processing position.

5. The sheet processing apparatus according to claim 2, wherein the scrap judging part includes:

a first judgement part for, when N=1 is set up by the Nth position setting part, judging whether the sheet piece formed on the reference position side of the first processing position is a scrap;

an nth judgement part for, when an integer n greater than or equal to 2 and smaller than Z mentioned above is specified by the Nth position setting part, judging whether the sheet piece formed on the reference position side of the nth processing position is a scrap; and a Zth judgement part for, when N=Z is set up by the Nth position setting part, judging whether the sheet piece formed on the counter-reference position side of the Zth processing position is a scrap, and wherein the slitter selecting part includes:

a first selection part for, when the judgment result of the first judgement part is "a scrap", selecting as the slitter to be employed at the first processing position the right type slitter in a case that the reference position is the right end or selecting the left type slitter in a case that the reference position is the left end;

an nth selection part for, when the judgment result of the nth judgement part is "a scrap", selecting, in a case that the reference position is the right end, the right type slitter as the slitter to be employed at the nth processing position and the left type slitter as the slitter to be employed at the (n−1)th processing position or selecting, in a case that the reference position is the left end, the left type slitter as the slitter to be employed at the nth processing position and the right type slitter as the slitter to be employed at the (n−1)th processing position; and a Zth selection part for, when the judgment result of the Zth judgement part is "a scrap", selecting as the slitter to be employed at the Zth processing position the left type slitter in a case that the reference position is the right end or selecting the right type slitter in a case that the reference position is the left end.

6. The sheet processing apparatus according to claim 2, wherein the processing machine selection control part includes:

a slitter source number storage part for storing a source number T indicating the number of each of the right type slitters and the left type slitters prepared in advance; and a slitter remaining number storage part for, at each time that the right type slitter or the left type slitter is selected by the slitter selecting part, subtracting the selected slitter from the source number T so as to acquire a remaining number Q of each of the right type slitters and the left type slitters and then storing the acquired value.

7. The sheet processing apparatus according to claim 4, wherein the scrap judging part includes:

a first judgement part for, when N=1 is set up by the Nth position setting part, judging whether the sheet piece formed on the reference position side of the first processing position is a scrap;

an nth judgement part for, when an integer n greater than or equal to 2 and smaller than Z mentioned above is specified by the Nth position setting part, judging whether the sheet piece formed on the reference position side of the nth processing position is a scrap; and a Zth judgement part for, when N=Z is set up by the Nth position setting part, judging whether the sheet piece formed on the counter-reference position side of the Zth processing position is a scrap, wherein the slitter selecting part includes:

a first selection part for, when the judgment result of the first judgement part is "a scrap", selecting as the slitter to be employed at the first processing position the right type slitter in a case that the reference position is the right end or selecting the left type slitter in a case that the reference position is the left end;

an nth selection part for, when the judgment result of the nth judgement part is "a scrap", selecting, in a case that the reference position is the right end, the right type slitter as the slitter to be employed at the nth processing position and the left type slitter as the slitter to be employed at the (n−1)th processing position or selecting, in a case that the reference position is the left end, the left type slitter as the slitter to be employed at the nth processing position and the right type slitter as the slitter to be employed at the (n−1)th processing position; and a Zth selection part for, when the judgment result of the Zth judgement part is "a scrap", selecting as the slitter to be employed at the Zth processing position the left type slitter in a case that the reference position is the right end or selecting the right type slitter in a case that the reference position is the left end, and wherein the processing machine selection control part includes:

a slitter source number storage part for storing a source number T indicating the number of each of the right type slitters and the left type slitters prepared in advance; and a slitter remaining number storage part for, at each time that the right type slitter or the left type slitter is selected by the slitter selecting part, subtracting the selected slitter from the source number T so as to acquire a remaining number Q of each of the right type slitters and the left type slitters and then storing the acquired value.

8. The sheet processing apparatus according to claim 4, wherein the processing machine selection control part includes:

a slitter source number storage part for storing a source number T indicating the number of each of the right type slitters and the left type slitters prepared in advance; and a slitter remaining number storage part for, at each time that the right type slitter or the left type slitter is selected by the slitter selecting part, subtracting the selected slitter from the source number T so as to acquire a remaining number Q of each of the right type slitters and the left type slitters and then storing the acquired value.

9. The sheet processing apparatus according to claim 7, wherein the slitter determining part includes:

a first determination part for, when the judgment result of the first judgement part is "not a scrap", determining that the slitter to be employed at the first processing position is "undetermined"; and an nth determination part invoked when the judgment result of the nth judgement part is "not a scrap", wherein the nth determination part includes:

an nth α judgment part for judging whether a width dimension D of the sheet piece formed on the reference position side of the nth processing position is greater than a predetermined dimension B;

an nth α determination part for, when the judgment result of the nth α judgment part is "D>B", determining that the slitter to be employed at the nth processing position is "undetermined";

an nth β judgment part for, when the judgment result of the nth α judgment part is "D≤B", judging whether the slitter to be employed at the (n−1)th processing position is "undetermined" and whether the remaining numbers of the right type slitters and the left type slitters are both one or greater;

an nth β determination part for, when the judgment result of the nth β judgment part is "yes", determining that the slitter to be employed at the nth processing position is "undetermined"; and an nth γ determination part for, when the judgment result of the nth β judgment part is "no", determining that the slitter to be employed at the nth processing position is of the same type as the slitter to be employed at the (n−1)th processing position, and wherein B mentioned above indicates a width directional distance between a cutting processing position of the right type slitter and a cutting processing position of the left type slitter in a state that the right type slitter arranged on the right side in the width direction and the left type slitter arranged on the left side in the width direction are in close contact with each other.

10. The sheet processing apparatus according to claim 8, wherein the processing machine selection control part includes an undetermined slitter settling part for settling the slitter to be employed at the Nth processing position and having been concluded as "undetermined" by the slitter determining part, and wherein the undetermined slitter settling part includes:

a tentative arrangement part for selecting one from three patterns consisting of (i) the right type slitter is adoptable, (ii) the left type slitter is adoptable, and (iii) both the right type slitter and the left type slitter are adoptable as the slitter to be employed at the Nth processing position and having been concluded as "undetermined", and then successively performing tentative arrangement;

a remain judging part for judging whether the number of each of the right type slitters and the left type slitters tentatively arranged falls within the range of the remaining number Q;

a tentative arrangement re-invoking part for, when the judgment result of the remain judging part is "not within the range of the remaining number Q", re-invoking the tentative arrangement part to newly perform tentative arrangement; and a tentative arrangement settling part for, when the judgment result of the remain judging part is "within the range of the remaining number Q", settling the tentative arrangement.

11. The sheet processing apparatus according to claim 2, wherein the processing machine selection control part includes:

a slitter source number storage part for storing a source number T indicating the number of each of the right type slitters and the left type slitters prepared in advance;

a slitter usage number storage part for, at each time that the right type slitter or the left type slitter is selected by the slitter selecting part, acquiring and storing a total number V of each of the right type slitters and the left type slitters having been selected; and a slitter settling part for comparing the source number T and the total number V with each other and then, when T>V is satisfied for the right type slitters, determining the "right type slitter" as the slitter to be employed and, when T>V is satisfied for the left type slitters, determining the "left type slitter" as the slitter to be employed.

12. The sheet processing apparatus according to claim 1, including a scrap exclusion member for excluding as a scrap a sheet piece having been cut.

13. The sheet processing apparatus according to claim 12, wherein the scrap exclusion member is provided in each of the right type slitters and the left type slitters, and wherein the scrap exclusion member is provided on the right side of the cutting processing position in the width direction in the right type slitter and provided on the left side of the cutting processing position in the width direction in the left type slitter.

14. The sheet processing apparatus according to claim 12, wherein the scrap exclusion member includes a sheet guide for going into contact with the sheet piece having been cut and for thereby guiding the sheet piece, and wherein the sheet guide is selectively displaceable between an exclusion mode in which the sheet piece is guided in an exclusion direction and a retreat mode in which the sheet piece is guided in a non-exclusion direction.

15. The sheet processing apparatus according to claim 13, wherein the scrap exclusion member includes a sheet guide for going into contact with the sheet piece having been cut and for thereby guiding the sheet piece, and wherein the sheet guide is selectively displaceable between an exclusion mode in which the sheet piece is guided in an exclusion direction and a retreat mode in which the sheet piece is guided in a non-exclusion direction.

16. The sheet processing apparatus according to claim 1, wherein the conveyance directional processing part is provided in the form of a unit and in freely attachable to and detachable from the processing apparatus body.

* * * * *